US005697802A

United States Patent [19]

Kawabe

[11] Patent Number: 5,697,802

[45] Date of Patent: Dec. 16, 1997

[54] ELECTRICAL CONNECTOR

[75] Inventor: Eiji Kawabe, Sagamihara, Japan

[73] Assignee: I-Pex Co., Ltd., Tokyo, Japan

[21] Appl. No.: 570,015

[22] Filed: Dec. 14, 1995

[30] Foreign Application Priority Data

Dec. 15, 1994 [JP] Japan ..... 6-312098
Dec. 20, 1994 [JP] Japan ..... 6-316886

[51] Int. Cl.[6] ..... H01R 13/62
[52] U.S. Cl. ..... 439/326
[58] Field of Search ..... 439/326, 541.5, 439/630, 636, 637

[56] References Cited

U.S. PATENT DOCUMENTS 5,030,115 7/1991 Regnier et al. ..... 439/541.5
5,176,523 1/1993 Lai ..... 439/541.5
5,334,046 8/1994 Brouillette et al. ..... 439/541.5
5,413,497 5/1995 Lwee ..... 439/326

*Primary Examiner*—P. Austin Bradley
*Assistant Examiner*—Yong Ki Kim
*Attorney, Agent, or Firm*—Varndell Legal Group

[57] ABSTRACT

Housings arranged in two stages above and below are constructed in such a way that the housing in the upper stage is located at, or can be evacuated to, a location where it does not interfere with the course along which an extension board is inserted into the housing in the lower stage.

7 Claims, 32 Drawing Sheets

ELECTRICAL CONNECTOR

BACKGROUND OF THE INVENTION

1. Field of the Invention

The present invention relates to an electrical connector for electrically connecting a motherboard and extension boards, and more particularly to an electrical connector for connecting memory modules such as DIMMs to internal add-on extension memory boards.

2. Description of the Related Art

In computer systems such as personal computers, a socket referred to as an electrical connector is generally mounted on a motherboard (main board) in order to connect extension boards such as extended interface boards for peripheral devices or extended memory boards to the motherboard. The motherboard and extension boards can be electrically connected by plugging the extension boards into the electrical connector.

The structure of a common electrical connector will be described here with the example of an electrical connector used to connect an extension memory module (hereinafter, "module") referred to as a DIMM (dual in-line memory module). This module corresponds to the extension board described above.

FIG. 40, a schematic perspective view illustrating the structure of a conventional electrical connector for DIMMs, depicts an electrical connector which is used in desktop personal computers. In FIG. 40, a housing 2 for housing modules is arranged in several rows (four rows in this case) on the motherboard 1. The user inserts a module 3 in the housing 2, allowing memory to be added on. When the housing 2 is arranged standing up on the motherboard 1, as illustrated in FIG. 40, the module 3 is held perpendicular to the motherboard 1.

Thus, the surplus space in the main body of a desktop personal computer allows the number of housing units to be increased and allows the modules to be held perpendicular to the motherboard. Limitations in the space of the main body in thin types of notebook personal computers, however, do not allow the housing 2 to be stood up in the main body as depicted in FIG. 40. In such cases, a housing 4 is provided parallel to the motherboard 5 as depicted in FIG. 41. Since space is required to insert a module 6 from the horizontal direction in this case as well, however, the module 6 is inserted from an oblique direction. That is, the module 6 is inserted from an oblique direction into the housing 4, the tip is connected to electrodes (not shown in figure) arranged inside the housing 4, and the module 6 is mounted while pushed down from this state to the motherboard 5 side. A latch mechanism (not shown in figure) is provided at the tip of an arm 7 of the socket 4. When the module 6 is mounted in the socket 4, both tips of the module 6 are engaged and secured by the latch mechanisms.

However, two extension boards need to be connected in order to extend system features in recent thin types of notebook personal computers. In this case, when the housing is lined up to the side, the surface area of the connector increases, precluding effective use of the space inside the main body. Thus, as depicted in FIG. 42, a method of arranging the housings in two stages above and below has been considered. In the structure illustrated in FIG. 42, however, efforts to insert the module 6 from an oblique direction into the lower stage housing **4*b* result in the problem of interference between the module 6 and the tip of an arm 7 of the upper stage housing 4*a*, making it difficult to mount the module 6 in the lower stage housing 4*b***.

Although the insertion of the module could be facilitated by widening the interval between the housing units arranged above and below or by widening the range of the aperture 8, this would not allow the space inside the main body to be used effectively.

The following problems also occur when the housings are arranged in two stages above and below.

Before these problems are discussed, however, the structure of a common electrical connector will be described first with reference to FIGS. 43 through 45. The housing of a single stage for an electrical connector will be described here.

FIG. 43 is a schematic perspective view of an electrical connector for DIMMs, and FIGS. 44 and 45 are schematic cross sections corresponding to the cross section M—M in FIG. 43. FIG. 44 depicts the module in a mounted state, while FIG. 45 depicts the module as it is being mounted.

In the electrical connector 10 shown in FIG. 43, reference numeral 11 is a housing formed with an insulating material. In appearance, it is C shaped. Along the longitudinal direction of the housing 11, a concave groove 12 is formed to house a module (not shown in figure). First movable terminals **13*a* and second movable terminals. 13*b* are arranged alternately at prescribed intervals in this groove 12**.

As shown in FIG. 44, the first movable terminals **13*a* and the second movable terminals 13*b* described above are formed at the tips of arc-shaped electrode pieces 16*a* and 16*b* having elastic force. When a module 14 is in a mounted state, the first movable terminals 13*a* are in contact with electrode terminals 15*a* formed on one side of the inserted module 14, and the second movable terminals 13*b* are in contact with electrode terminals 15*b* formed on the other side of the module 14**.

When the module 14 is mounted in the electrical connector 10 described above, one end of the module 14 is inserted from an oblique direction into the groove 12 of the housing 11, as illustrated in FIG. 45, and the other end of the module 14 is rotated in the direction indicated by the arrow. When this is done, the first movable terminals **13*a* and second movable terminals 13*b* bend from the center of the grooves 12 toward the outside, and the module 14 is held by the their elastic pressing force. At the same time, the movable terminals 13*a* and 13*b* of the housing 11 are electrically connected by elastic contact with the electrode terminals 15*a* and 15*b* of the module 14**.

As shown in FIG. 48, meanwhile, arms **17*a* and 17*b* for holding the module (not shown in figure) are formed at both ends of the housing 11. Additionally, latches 18*e* and 18*b* inwardly energized by means of plate springs (not shown in figure) are arranged facing each other at the tips of the arms 17*a* and 17*b*. When the module 14 is inserted into the groove 12 of the housing 11 and is rotated, as shown in FIG. 45, the latches 18*a* and 18*b* shown in FIG. 43 are pushed by the side of the module 14 and are bent outward, and when the module 14 is completely mounted inside the housing 11, they are returned to their original position by the energizing force of the plate springs and secure the edges of the module. That is, one edge along the longitudinal direction of the module mounted in the housing 11 is held by the movable terminals 13*a* and 13*b* inside the groove 12, while both side ends are held by the latches 18*a* and 18*b***.

When the module 14 is taken out of the housing 11, levers **19*a* and 19*b* formed at one end of the latches 18*a* and 18*b* are pushed outward. When this is done, the side on which the module 14 has been secured is released, and the module 14** is pushed out by the pressing force of the movable terminals 13*a* and 13*b* to the point prior to rotation, where it can then be taken out of the housing 11.

Because the first movable terminals 13*a* and second movable terminals 13*b* described above are separately arranged, when the housings are arranged in two stages above and below, first movable terminals 13*a* and second movable terminals 13*b* must be arranged in each stage of the housings. The electrode terminals of the extension board, however, total about 70 on both sides, in DIMMs, for example. When the housings are arranged in two stages, upward of 140 movable terminals must be provided in the upper and lower stages combined. Thus, when the number of housings is doubled in conventional terminal structures, there have been problems in that the number of electrode parts constituting the movable terminals is doubled, with much time and labor spent on the installation of the movable terminals arranged above and below.

SUMMARY OF THE INVENTION

A first object of the present invention is to provide an electrical connector having housings arranged in two stages above and below, capable of allowing an extension board to be readily inserted into the lower stage housing.

A second object of the present invention is to provide an electrical connector having housings arranged in two stages above and below, wherein the number of electrode parts is kept to about the same number as for one stage housing, and which allows electrode parts arranged above and below to be mounted in a simple manner.

To achieve the first object, an electrical connector for electrically connecting a motherboard and extension boards in the present invention is provided with at least two housings, into which extension boards are inserted, arranged one over another in such a manner that a housing on an upper stage side is disposed in a location where it will not interfere with a course along which an extension board is inserted into a housing on a lower stage side.

When an extension board is inserted into the housing on the lower stage side in the electrical connector of the first invention described above, there is no interference between the housing on the upper stage side and the extension board which is being inserted, allowing the extension board to be readily inserted into the lower stage side. As a result, an extension board can be readily inserted into each housing even in structure where the housing has been arranged in two stages above and below. Two extension boards can accordingly be connected without increasing the space of the main body.

To achieve the second object, an electrical connector for detachably holding extension boards on a motherboard and for electrically connecting the extension boards and a motherboard comprises two housings, into which extension boards provided with electrode terminals on both sides thereof are inserted, arranged one over another; and a plurality of alternately arranged first and second movable terminals provided in each of the housings, the first and second movable terminals being adapted to contact with the electrode terminals on both sides of the extension boards, wherein corresponding ones of the first movable terminals which are identically located planewise in the upper and lower housings are formed integrally, and corresponding ones of the second movable terminals which are identically located planewise in the upper and lower housings are formed integrally.

With this construction, even when the housings are arranged in two stages, the number of electrode parts can be kept to about the same number as for one housing. Furthermore, because the first and second movable terminals in each of the housings in the upper and lower stages can be attached all at once, the electrode parts can be readily installed.

The purpose and advantages of the present invention can be readily confirmed by means of the following detailed description and appended drawings.

BRIEF DESCRIPTION OF THE DRAWINGS

FIG. 3 is a cross section along line A—A in. FIG. 2;

DESCRIPTION OF THE PREFERRED EMBODIMENTS

Preferred embodiments of an electrical connector pertaining to the present invention are described below with reference to the accompanying figures.

Preferred embodiments of an electrical connector pertaining to the first invention are described first. Here, Embodiments 1 through 7 are for applications of the electrical connector of the first invention as a connector for DIMMs.

Embodiment 1

Figure 1:
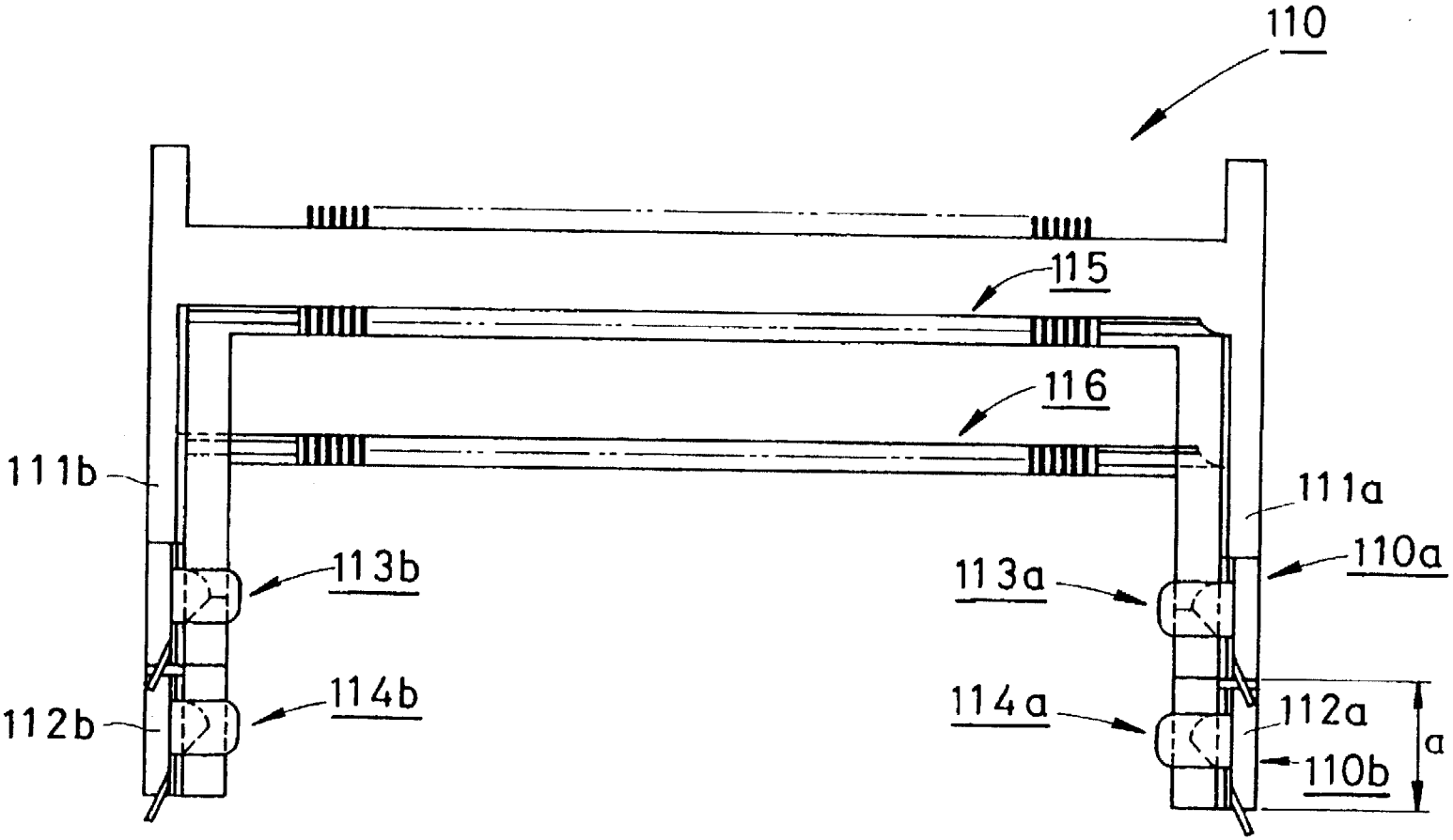
FIG. 1 is a schematic plan view of the connector in Embodiment 1.
Figure 2:
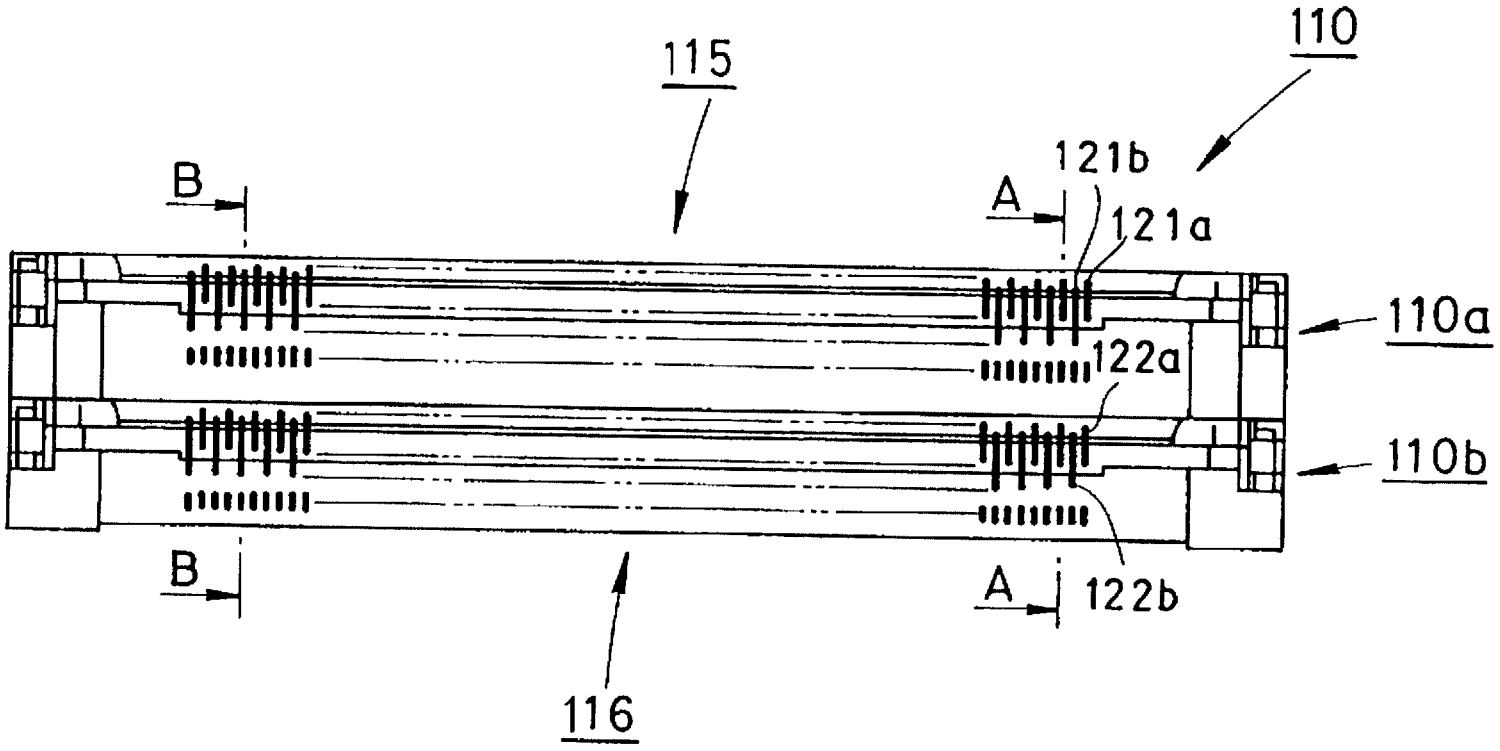
FIG. 2 is a schematic front view of the connector in Embodiment 1.
Figure 3:
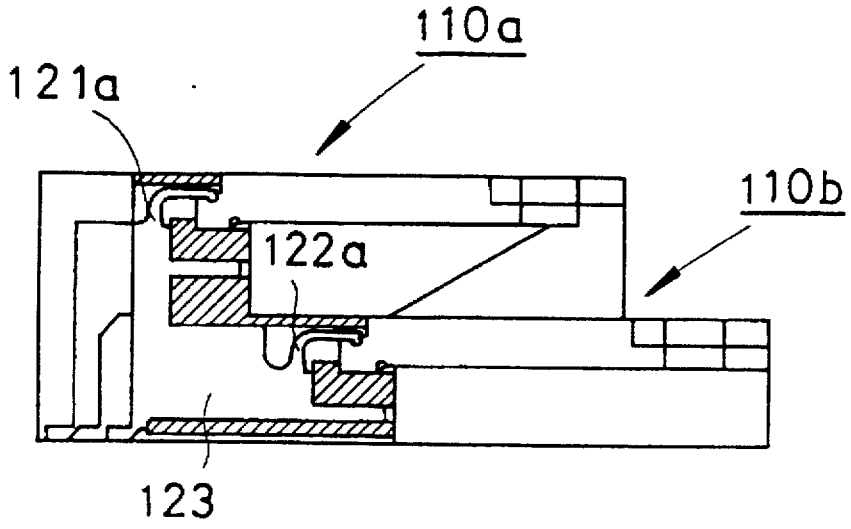
Figure 4:
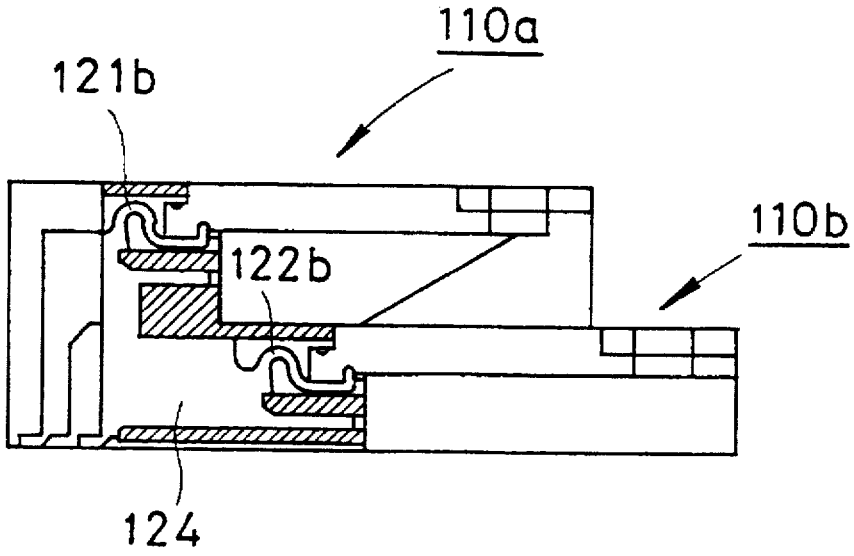
FIG. 4 is a cross section along line B—B in FIG. 1.
Figure 5:
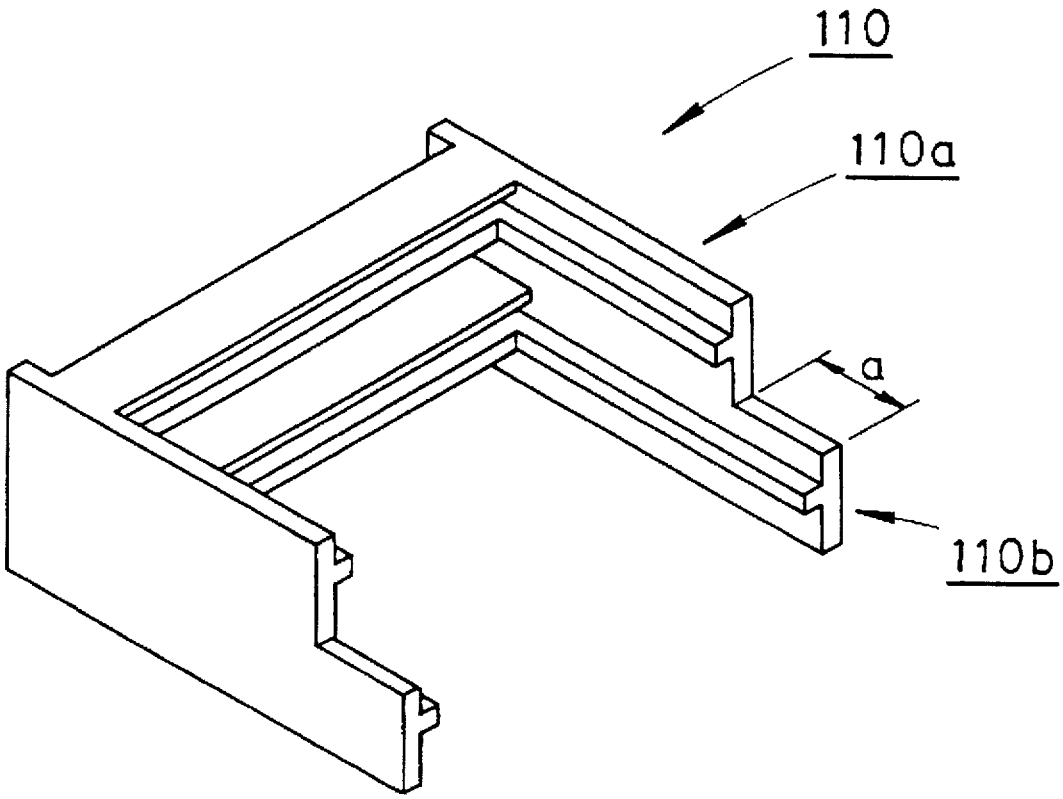
FIG. 5 is a schematic perspective view of the connector in Embodiment 1.

FIGS. 1 through 5 depict the structure of the connector in Embodiment 1. FIG. 1 is a schematic plan view, FIG. 2 is a schematic front view, FIG. 3 is a cross section along line A—A in FIG. 2, FIG. 4 is a cross section along line B—B in FIG. 2, and FIG. 5 is a schematic perspective view.

In FIG. 1, a connector 110 is a connector for connecting two modules (not shown in figure). As shown in FIG. 2, two housing units 110*a* and 110*b* are arranged in two stages above and below.

The main body of the connectors shown in Practical Embodiments 1 through 7 and in Practical Embodiment 8 comprise insulating materials and are constructed roughly in the form of a [ (planewise).

Arm components 11*a* and 11*b* for holding the module are located at both ends of the housing 110*a* located in the upper stage, and latch components 113*a* and 113*b* for engaging with the sides of the module are located at the tips of the arm components.

Arm components 112*a* and 112*b* for holding a module are meanwhile located at both ends of the housing 110*b* located in the lower stage, and latch components 114*a* and 114*b* for engaging with the sides of the module are located at the tips of the arm components.

The arm components 111*a*, 111*b*, 112*a*, and 112*b* described above are each located in fixed positions.

Connector electrode components 115 and 116 are also arranged in the widthwise direction of each of the housings 110*a* and 110*b*.

The connector electrode component 115 is constructed of electrodes 121*a* and 121*b* divided in two above and below, as shown in FIG. 2. The connector electrode component 116, meanwhile, is similarly constructed of electrodes 122*a* and 122*b* divided in two above and below, as shown in FIG. 2.

The electrodes divided in two above and below are integrally formed with each connector electrode component above and below. That is, the upper electrodes 121*a* and 122*a* in the connector electrode components 115 and 116 are integrally formed in the form of an upper connector electrode 123, as shown in FIG. 3 (cross section A—A of FIG. 2). Similarly, the lower electrodes 121*b* and 122*b* in the connector electrode components 115 and 116 are integrally formed in the form of a lower connector electrode 124, as shown in FIG. 4 (cross section B—B of FIG. 2). The connector electrode components 115 and 116 are thus formed with the alternating arrangement of several of these integrally formed contacts.

When modules (not shown in figure) are plugged between the electrodes thus divided into two above and below, these electrodes divided in two above and below come into contact with the electrodes formed on both sides of the edge of the module, thus ensuring electrical conduction. The structure of the electrodes is described in detail in Embodiment 8.

Meanwhile, as shown in FIG. 1, the tip of the upper stage housing 110*a* is arranged at a distance (a) horizontal to the tip of the lower stage housing 110*b*, resulting as a whole in the stepped form depicted in the schematic perspective view of FIG. 5. The latch components and the like have been omitted in FIG. 5.

When the upper stage housing 110*a* is thus arranged at a distance (a) with respect to the lower stage housing 110*b*, the upper stage housing 110*a* will not interfere with the course along which a module (not shown in figure) is inserted into the lower stage housing 110*b*. That is, the distance (a) is determined at a length allowing the upper stage housing 110*a* to not interfere with the course of the module when the module (not shown in figure) is inserted at a specified angle into the lower stage housing 110*b*. The length of the distance (a) accordingly differs depending on the angle at which the module (not shown in figure) is inserted into the lower stage housing 110*b*.

The procedure for mounting modules in housings 110*a* and 110*b* of the connector 110 described above is described next. Here, for the sake of convenience, the description is made with reference to FIGS. 6 and 7 corresponding to FIG. 3, although it goes without saying that the modules to be inserted come into contact with the electrodes arranged above and below on the connector electrode components.

Figure 6:
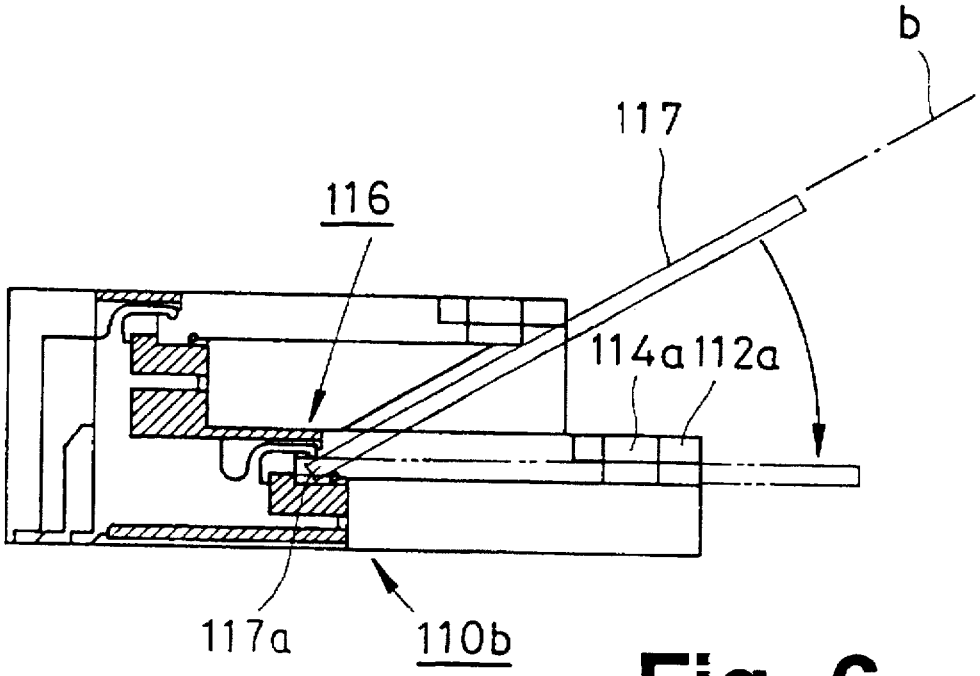
FIG. 6 is an illustration depicting a procedure for mounting a module in the connector of Embodiment 1.

First, as shown in FIG. 6, a first module 117 is inserted along course (b) into the lower stage housing 110*b*, and the electrodes (not shown in figure) formed on both sides of the tip 117*a* of the module 117 come into contact with the electrodes of the connector electrode component 116. Module 117 is then pushed down in the direction indicated by the arrow and housed in the arm component 112*a* (and 112*b* (not shown in figure) on the opposite side) of the housing 110*b*. At this time, both sides of the module 117 are engaged by the latch component 114*a* (and 114*b* (not shown in figure) on the opposite side), and the module 117 is thus mounted in the housing 110*b*.

Figure 7:
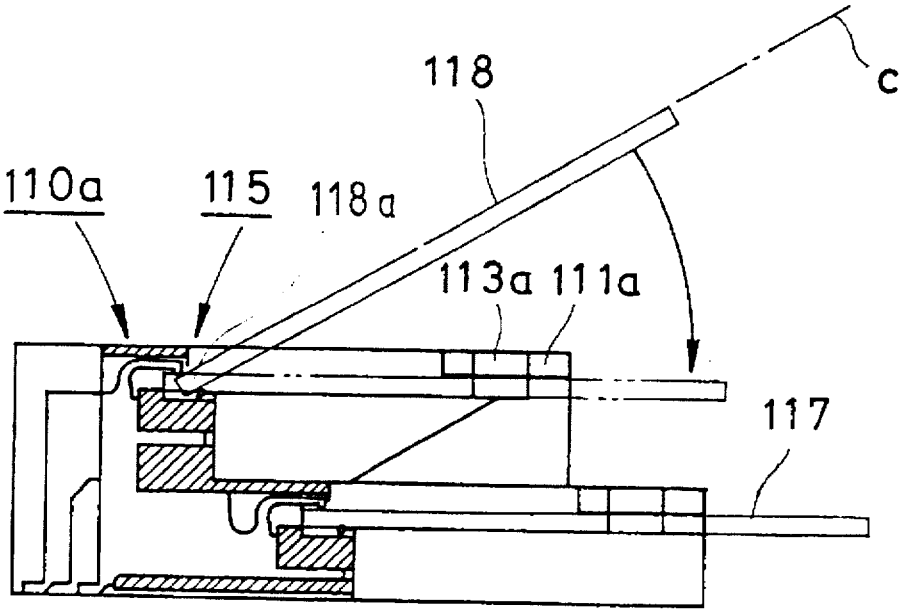
FIG. 7 is an illustration depicting a procedure for mounting a module in the connector of Embodiment 1.

Next, as shown in FIG. 7, a second module 118 is inserted along course (c) into the upper stage housing 110*a*. The angle of course (c) at this time may be greater than the angle in course (b). The electrodes of the connector electrode component 115 then come into contact with the electrodes (not shown in figure) formed on both sides of the tip 118*a* of module 118. Module 118 is then pushed down in the direction indicated by the arrow and housed in the arm component 111*a* (and 111*b* (not shown in figure) on the opposite side) of the housing 110*a*. At this time, both sides of the module 118 are engaged by the latch component 113*a* (and 113*b* (not shown in figure) on the opposite side), and the module 118 is thus mounted in the housing 110*a*.

When the module 117 is thus inserted into the lower stage housing 110*b*, the lack of any interference between the module 117 and the latch component 113*a* (and 113*b*) of the upper stage housing 110*a* allows the module 117 to be readily inserted into the lower stage housing 110*b*. After the first module 117 has been mounted in the lower stage housing 110*b*, the second module 118 can be mounted as such in the upper stage housing 110*a* without moving the housing.

Embodiment 2

In the connector 110 of Embodiment 1 above, the upper stage housing 110*a* is arranged at a distance (a) with respect to the lower stage housing 110*b*, but the same effects can be obtained when the upper stage housing 110*a* is movably constructed parallel to the lower stage housing 110*b*.

Figure 8:
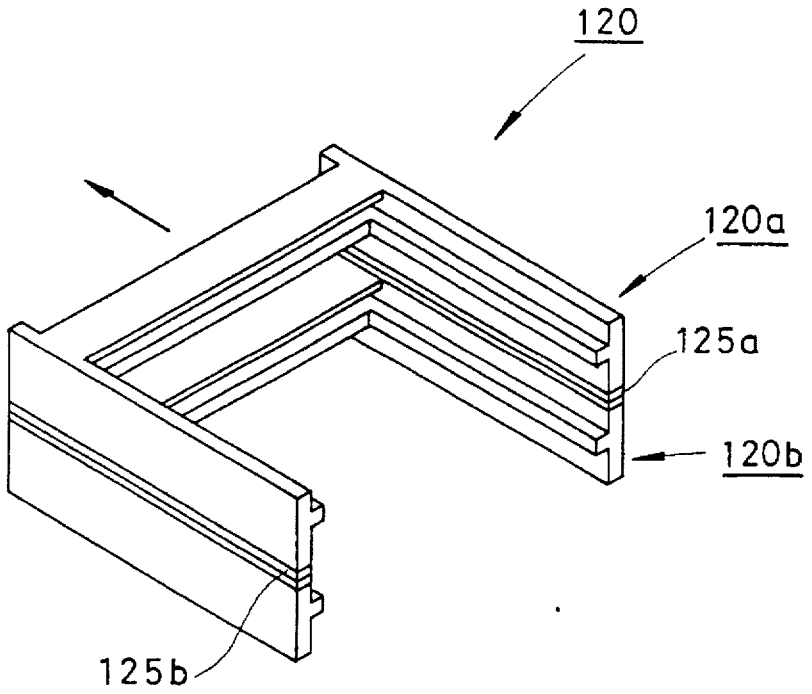
FIG. 8 is a schematic perspective view of the connector in Embodiment 2.

FIG. 8 is a schematic perspective view of a connector 120 in Embodiment 2. In this connector 120, carrier platforms 125*a* and 125*b* are located between housing 120*a* and 120*b* arranged in two stages above and below. These carrier platforms 125*a* and 125*b* each consist of a pair of (upper and lower) rails. These rails are fashioned so that they slide in a direction aligned with the direction in which the module is mounted When mutually engaged. Consequently, when the connector 120 is fixed on the motherboard (not shown in figure), the upper stage housing 120*a* is allowed to slide in a direction horizontal to the lower stage housing 120*b*. This allows the upper stage housing 120*a* to slide in the direction indicated by the arrow in the figure when a module is inserted into the lower stage housing 120*b*, so that the upper stage housing 120*a* can be evacuated to a point where it will not interfere with the course along which a module is inserted into the lower stage housing 120*b*.

Figure 9:
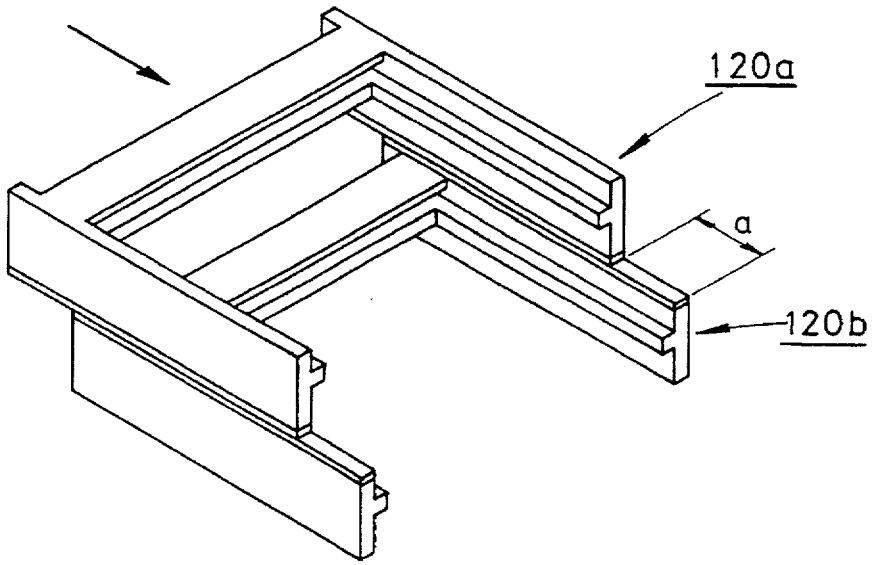
FIG. 9 is a schematic perspective view of the connector in Embodiment 2.

In the connector 120 shown in FIG. 8, when a first module is inserted into the lower stage housing 120*b*, the upper stage housing 120*a* is pushed in the direction indicated by the arrow and is moved a specified distance (for example, distance (a) in FIG. 1) with respect to the lower stage housing 120*b*, as shown in FIG. 9. The first module (not shown in figure) is then inserted into the lower stage housing 120*b* by the procedure indicated in FIG. 6. The upper stage housing 120*a* is subsequently retracted in the direction indicated by the arrow in FIG. 9 and is moved to the location shown in FIG. 8, and a second module (not shown in figure) is inserted into the upper stage housing 120*a*. The second module may be inserted before the upper stage housing 120*a* is moved to the location shown in FIG. 8. The latches and the like are omitted in FIGS. 8 and 9.

Embodiment 3

Figure 10:
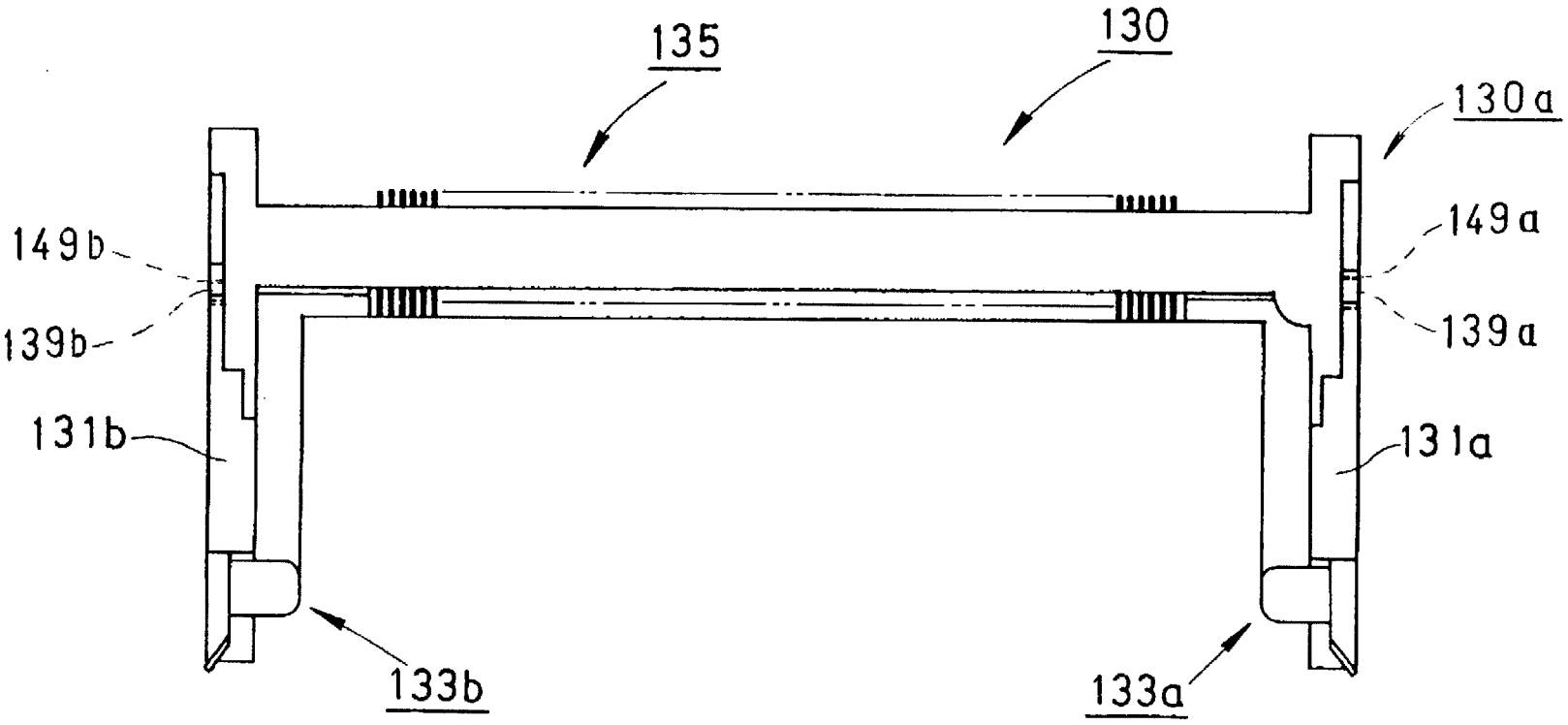
FIG. 10 is a schematic plan view of the connector in Embodiment 3.
Figure 11:
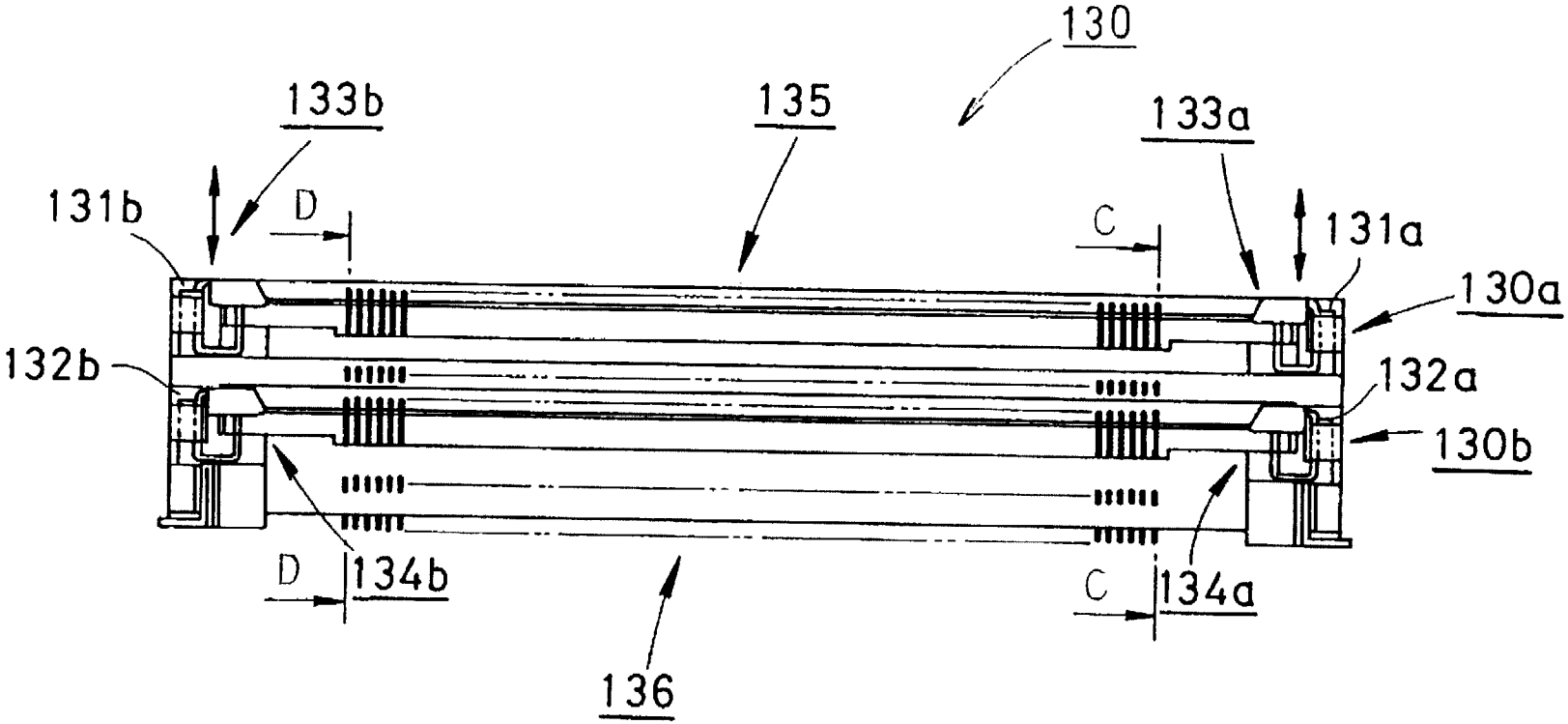
FIG. 11 is a schematic front view of the connector in Embodiment 3.
Figure 12:
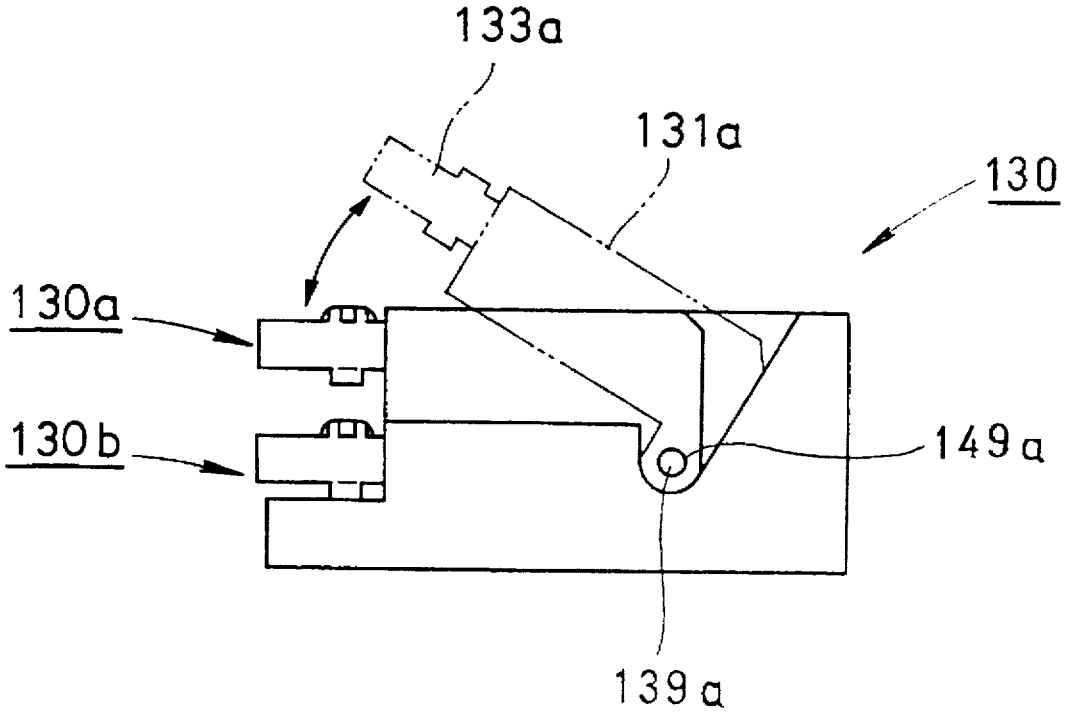
FIG. 12 is a diagram of the right side of FIG. 11.
Figure 13:
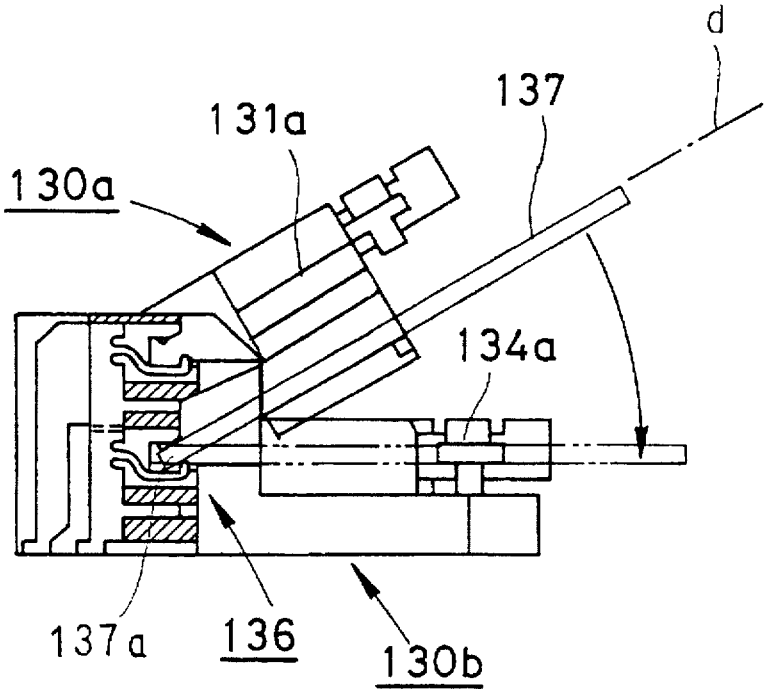
FIG. 13 is a cross section along line C—C in FIG. 11.
Figure 14:
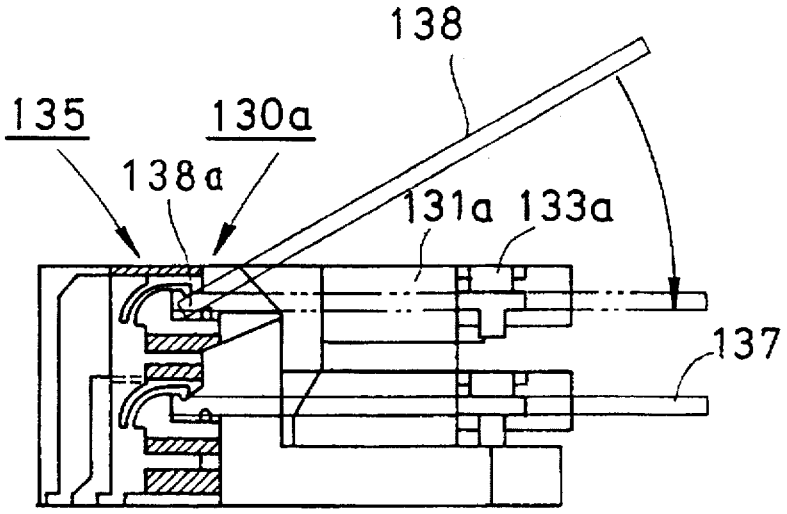
FIG. 14 is a cross section along line D—D in FIG. 11.

FIG. 10 is a schematic plan view of a connector 130 in Embodiment 3, FIG. 11 is a schematic front view, FIG. 12 is a right side view, FIG. 13 is a cross section along line C—C in FIG. 11, and FIG. 14 is a cross section along line D—D in FIG. 11.

In this connector 130, as shown in FIGS. 10 and 11, the housing units 130*a* and 130*b* (not shown in FIG. 10) are arranged in two stages above and below at locations that are aligned roughly planewise.

Arm components 131*a* and 131*b* for holding a module are arranged at both ends of the housing 130*a* located in the upper stage, while latch components 133*a* and 133*b* for engaging the sides of the module are located at the tips of the arm components.

As shown in FIG. 11, arm components 132*a* and 132*b* for holding a module are meanwhile arranged at both ends of the housing 130*b* located in the lower stage, while latch components 134*a* and 134*b* for engaging the sides of the module are located at the tips of the arm components. Connector electrode components 135 and 136 having the same structure as in Embodiment 1 are arranged in the widthwise direction of the housing 130*a* and 130*b*.

As shown in FIG. 10, moreover, support shafts 139*a* and 139*b* are arranged so that they protrude on either side of the connector 130. Support shafts 139*a* and 139*b* are fitted into holes 149*a* and 149*b* that are formed at either end of the arm components 131*a* and 131*b* of the upper stage housing 130*a*. That is, the arm components 131*a* and 131*b* are rotatably supported, pivoting on the support shafts 139*a* and 139*b* arranged parallel to the longitudinal direction of the lower stage housing 130*b*. This allows the arm components 131*a* (and 131*b* (not shown in figure) on the opposite side) to rotate clockwise, pivoting on the support shaft 139*a* (and 139*b* (not shown in figure) on the opposite side), as shown in FIG. 12, so that the upper stage housing 130*a* can be evacuated to a location where it will not interfere with the course along which a module is inserted into the lower stage housing 130*b*.

The structures of the arm components and connector main body described above are not limited to the structures given in the preferred embodiments. Other structures may be adopted, provided that they can function in the same manner. For example, plates can be connected between arm components 131*a* and 131*b*, and the left and right arm components can be constructed so that they rotate simultaneously.

The support shafts may be arranged facing inwardly at locations corresponding to the holes 149*a* and 149*b* in the arm components 131*a* and 131*b* described above, holes may be formed in locations corresponding to the support shafts 139*a* and 139*b* in the connector 130, and the support shafts located in the arm components may be fitted into the holes formed in the connector, so that the arm components 131*a* and 131*b* are rotatably supported, pivoting on the support shafts described above.

In the connector 130 in Embodiment 3, the arm components 131*a* and 131*b* were constructed in such a way that they opened 30 degrees upward in the horizontal direction, but this angle can be determined within a range in which the upper stage housing 130*a* will not interfere with the module when the module is inserted into the lower stage housing 130*b*.

The procedure for mounting modules in housing units 130*a* and 130*b* of the connector 130 described above is described next with reference to FIGS. 13 and 14. Here, the description is provided using the right side arm component 131*a* as an example. The support shaft 139*a* is not depicted in FIGS. 13 and 14, but the description is given here as if the support shaft 139*a* were shown in FIGS. 13 and 14.

First, as shown in FIG. 13, the arm component 131*a* of the upper stage housing 130*a* rotates counterclockwise, pivoting on the support shaft (139*a*), thus ensuring the course along which a module is inserted into the lower stage housing 130*b*. A first module 137 is then inserted into the lower stage housing 130b along course (d), and the electrodes of the connector electrode component 136 are then brought into contact with the electrodes (not shown in figure) formed on both sides of the edge 137a of the module 137. The module 137 is then pushed down in the direction indicated by the arrow and is housed in the housing 130b. At this time, the latch component 134a (and 134b (not shown in the figure) on the opposite side) engages the module 137 on one side, and the module 137 is thus mounted in the housing 130b.

Next, as shown in FIG. 14, the arm component 131a of the upper stage housing 130a is rotated clockwise, pivoting on the support shaft (139a), and is returned to a position allowing a module to be inserted into the upper stage housing 130a. A second module 138 is then inserted into the upper housing 130a, and the electrodes of the connector electrode component 135 are then brought into contact with the electrodes (not shown in figure) formed on both sides of the edge 138a of the module 138. The module 138 is then pushed down in the direction indicated by the arrow and is housed in the housing 130a. At this time, the latch component 133a (and 133b (not shown in the figure) on the opposite side) engages the module 138 on one side, and the module 138 is thus mounted in the housing 130a.

With the connector 130 of Embodiment 3, the upper stage housing 130a opens upward when the module 137 is inserted into the lower stage housing 130b, thus ensuring a course for a module to be inserted into the lower stage housing 130b. Thus, when the first module 137 is inserted, the latch component 133a (and 133b (not shown in figure) on the opposite side) of the upper stage housing 130a does not interfere with the module 137, allowing the module 137 to be readily inserted into the lower stage housing 130b.

Embodiment 4

Figure 15:
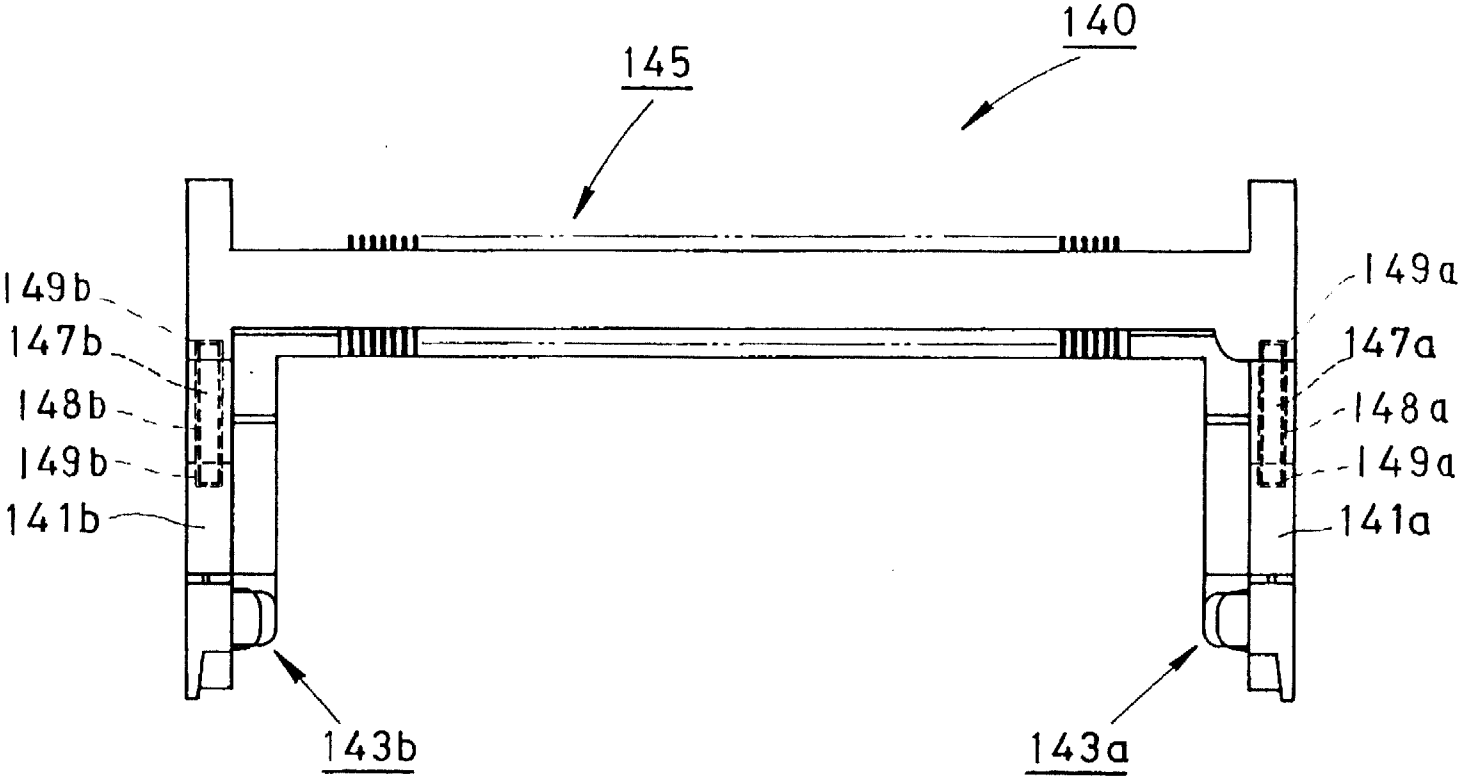
FIG. 15 is a schematic plan view of the connector in Embodiment 4.
Figure 16:
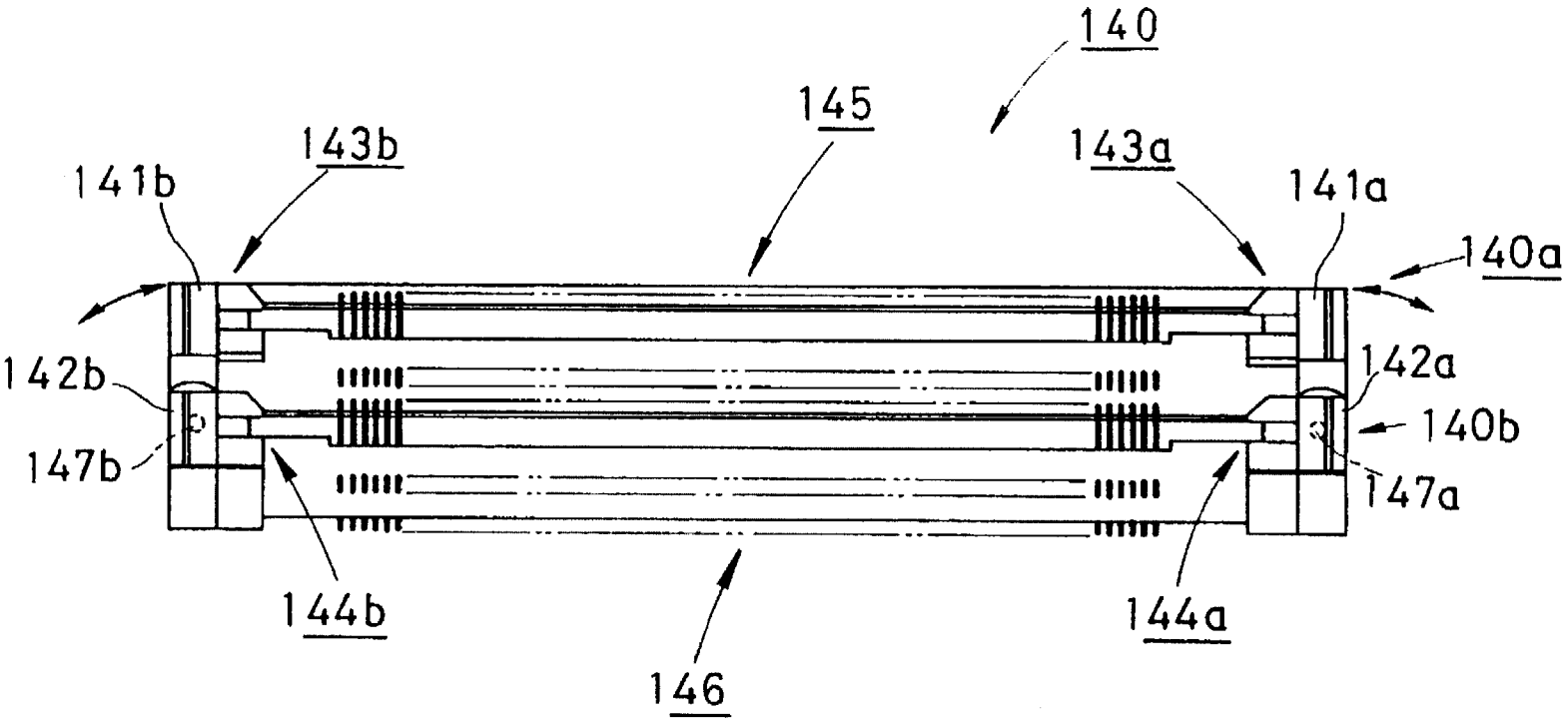
FIG. 16 is a schematic front view of the connector in Embodiment 4.
Figure 17:
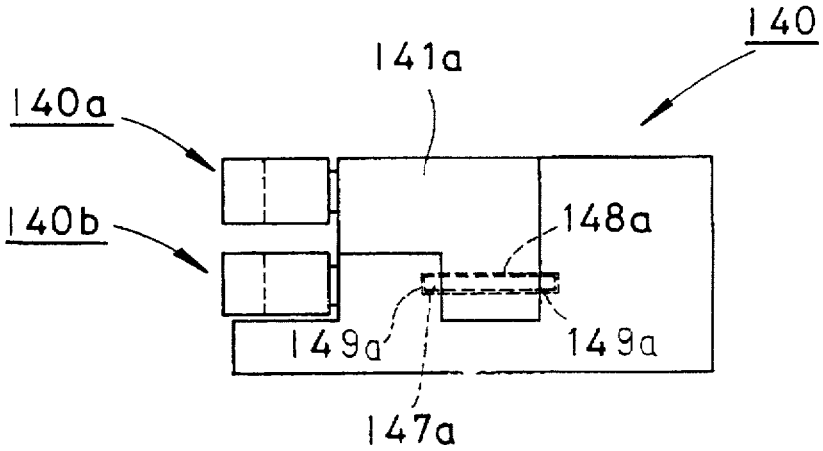
FIG. 17 is a diagram of the right side of FIG. 15.
Figure 18:
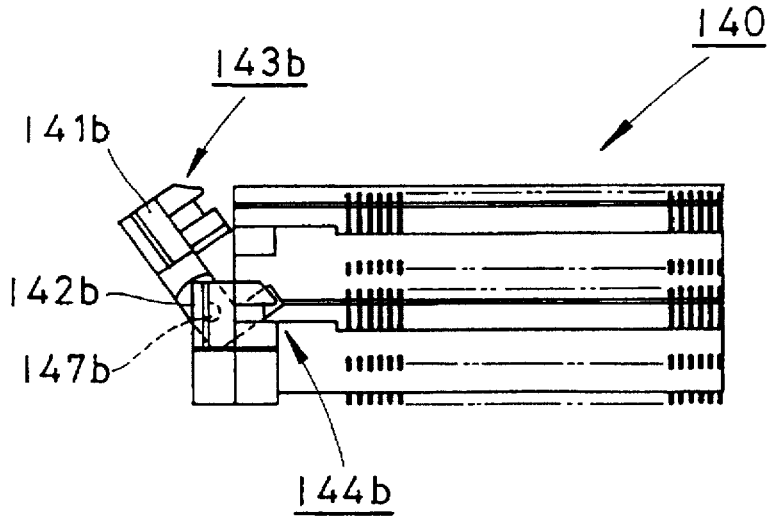
FIG. 18 is a partial front view of FIG. 16.

FIG. 15 is a schematic plan view of a connector 140 in Embodiment 4, FIG. 16 is a schematic front view, FIG. 17, is a right side view, and FIG. 18 is a partial front view of FIG. 16.

In this connector 140, as shown in FIG. 16, housing units 140a and 140b are arranged in two stages above and below at locations that are aligned roughly planewise.

Arm components 141a and 141b for holding a module are arranged at both ends of the housing 140a located in the upper stage, while latch components 143a and 143b for engaging the sides of the module are located at the tips of the arm components.

Arm components 142a and 142b for holding a module are meanwhile arranged at both ends of the housing 140b located in the lower stage, while latch components 144a and 144b for engaging the sides of the module are located at the tips of the arm components. Connector electrode components 145 and 146 having the same structure as in Embodiment 1 are arranged in the widthwise direction of the housing 140a and 140b.

Moreover, the arm components 141a and 141b of the upper stage housing 140a are supported so that they are rotatable clockwise and counterclockwise, pivoting on support shafts 147a and 147b arranged orthogonal to the longitudinal direction of the lower stage housing 140b.

The structures of the arm components and support shafts are described with reference to FIG. 17 using the right side arm component 141a and support shaft 147a as examples. In FIG. 17, the arm component 141a is formed roughly in the shape of an L, and a hole 148a is formed at one end. This hole 148a passes through one end of the arm component 141a. Holes 149a which do not pass through the main body component are meanwhile formed in two locations in the main body component of the connector 140. These two holes 149a are formed in locations which face the hole 148a when the arm component 141a is fitted into the connector 140. The arm component 141a and connector 140 are rotatably supported via the support shaft 147a embedded through holes 148a and 149a. This support shaft 147a is constructed in such a way that a coil spring (not shown in figure) is housed in the interior, so that one end of the support shaft is extendable and retractable by means of the coil spring.

Although not shown in FIG. 17, the arm component 141b on the opposite side is also rotatably supported by means of a hole 148b, holes 149b, and a support shaft 147b. FIG. 16 depicts the state in which the arm components 141a and 141b are initially located.

The structures of the arm components and connector main body described above are not limited to the structures given in the embodiment. Other structures may be adopted, provided that they can function in the same manner. For example, support shafts may be arranged so that they protrude on either side at one end of the arm components 141a and 141b, and the support shafts may be fitted into the holes 149a and 149b of the connector 140. Alternatively, the support shafts may be arranged so that they protrude at locations corresponding to holes 149a and 149b of the connector 140, and the support shafts may be engaged by the holes 148a and 149a.

The operation of the arm component described above is described below with reference to FIG. 18 using the left side arm component 141b as an example.

As shown in FIG. 18, the arm component 141b, when viewing the connector 140 from the front, is constructed so that it is rotatable counterclockwise, pivoting on the support shaft 147b, from a position (fixed position) aligned roughly planewise with the lower stage arm component 142b. The arm component 141a (not shown in figure) on the opposite side is also constructed so that it is rotatable clockwise, pivoting on the support shaft 147a.

In the structure described above, when a module is inserted into the lower stage housing 140b, the arm component 141b rotates counterclockwise, pivoting on the support shaft 147b, and the arm component 141a on the opposite side (not shown in figure) rotates counterclockwise, pivoting on the support shaft 147a. When this is done, the arm components 141a and 141b open left and right, and the upper stage housing 140a can be evacuated to a point where it will not interfere with the course along which a module is inserted into the lower stage housing 140b. The arm components 141a and 141b can also be constructed so that they rotate outwardly from the fixed positions shown in FIG. 16 but do not rotate inwardly.

The procedure for mounting modules in the housing 140a and 140b of the connector 140 described above is described next with reference to FIGS. 15 and 16.

First, the arm components 141a and 141b of the upper stage housing 140a are pushed out to the left and right clockwise and counterclockwise, respectively, by pivoting on the support shafts 147a and 147b, thus ensuring the course along which a module is inserted into the lower stage housing 140b. A first module (not shown in figure) is then inserted into the lower stage housing 140b along a given course, and the electrodes of the connector electrode component 146 are then brought into contact with the electrodes (not shown in figure) formed on both sides of the edge of the module. The module is then pushed down and is housed in the housing 140b. At this time, the latch components 144a and 144b engage the module on either side, and the module is thus mounted in the housing 140b.

Next, the arm components 141a and 141b of the upper stage housing 140a are returned to their original positions (fixed locations), resulting in a state allowing a module to be inserted into the upper stage housing 140a. A second module is then inserted into the upper housing 140a, and the electrodes of the connector electrode component 145 are then brought into contact with the electrodes (not shown in figure) formed on both sides of the edge of the module. The module is then pushed down in the direction indicated by the arrow and is housed in the housing 140a. At this time, the latch components 143a and 143b engage the module on either side, and the module is thus mounted in the housing 140a.

With the connector in Embodiment 4, the arm components of the upper stage housing 140a open to the left and right when the module is inserted into the lower stage housing 140b, thus ensuring a course for a module to be inserted into the lower stage housing 140b. Thus, when the first module is inserted, the latch component 144a (and 144) of the upper stage housing 140a does not interfere with the module, allowing the module to be readily inserted into the lower stage housing 140b.

Embodiment 5

Figure 19:
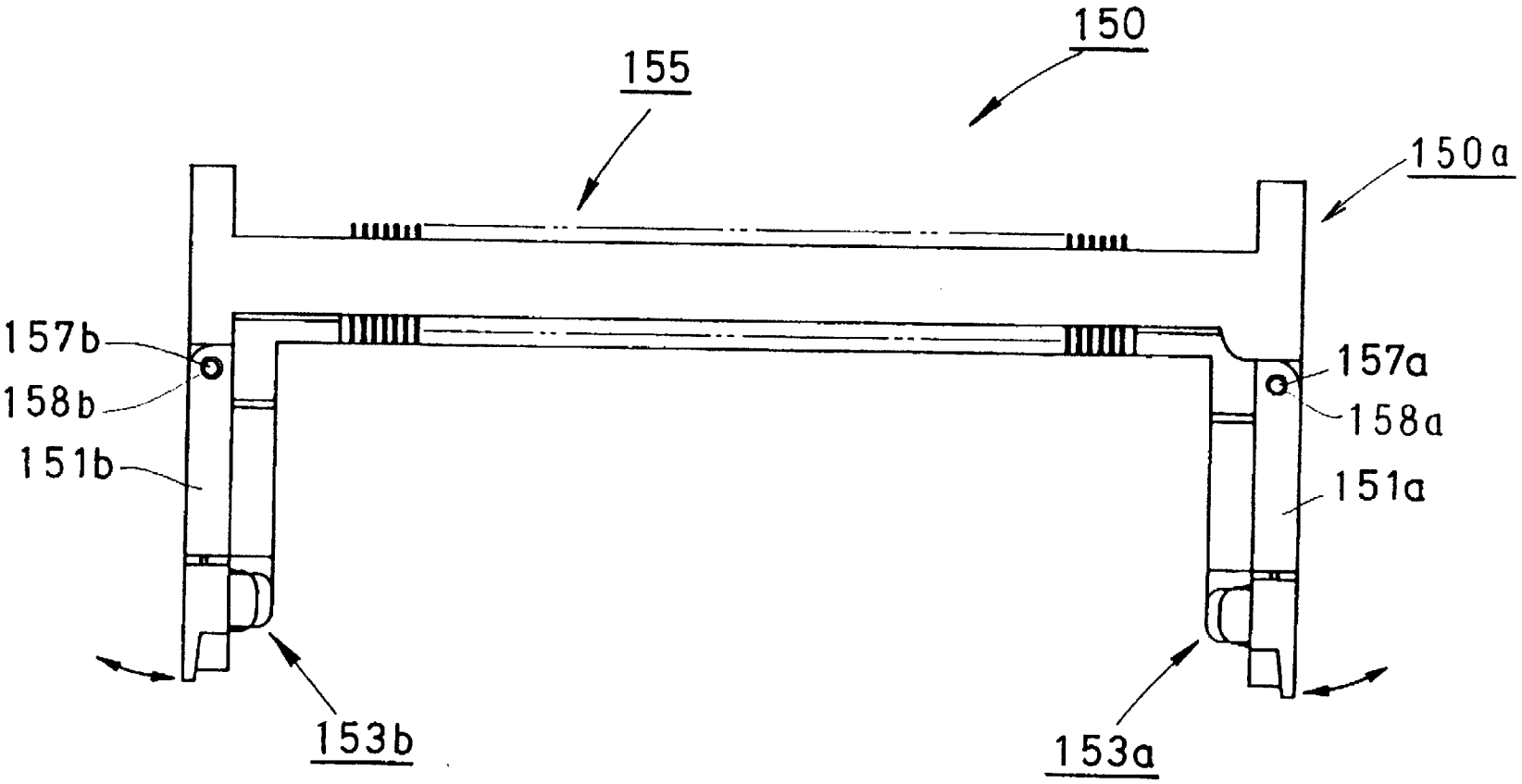
FIG. 19 is a schematic plan view of the connector in Embodiment 5.
Figure 20:
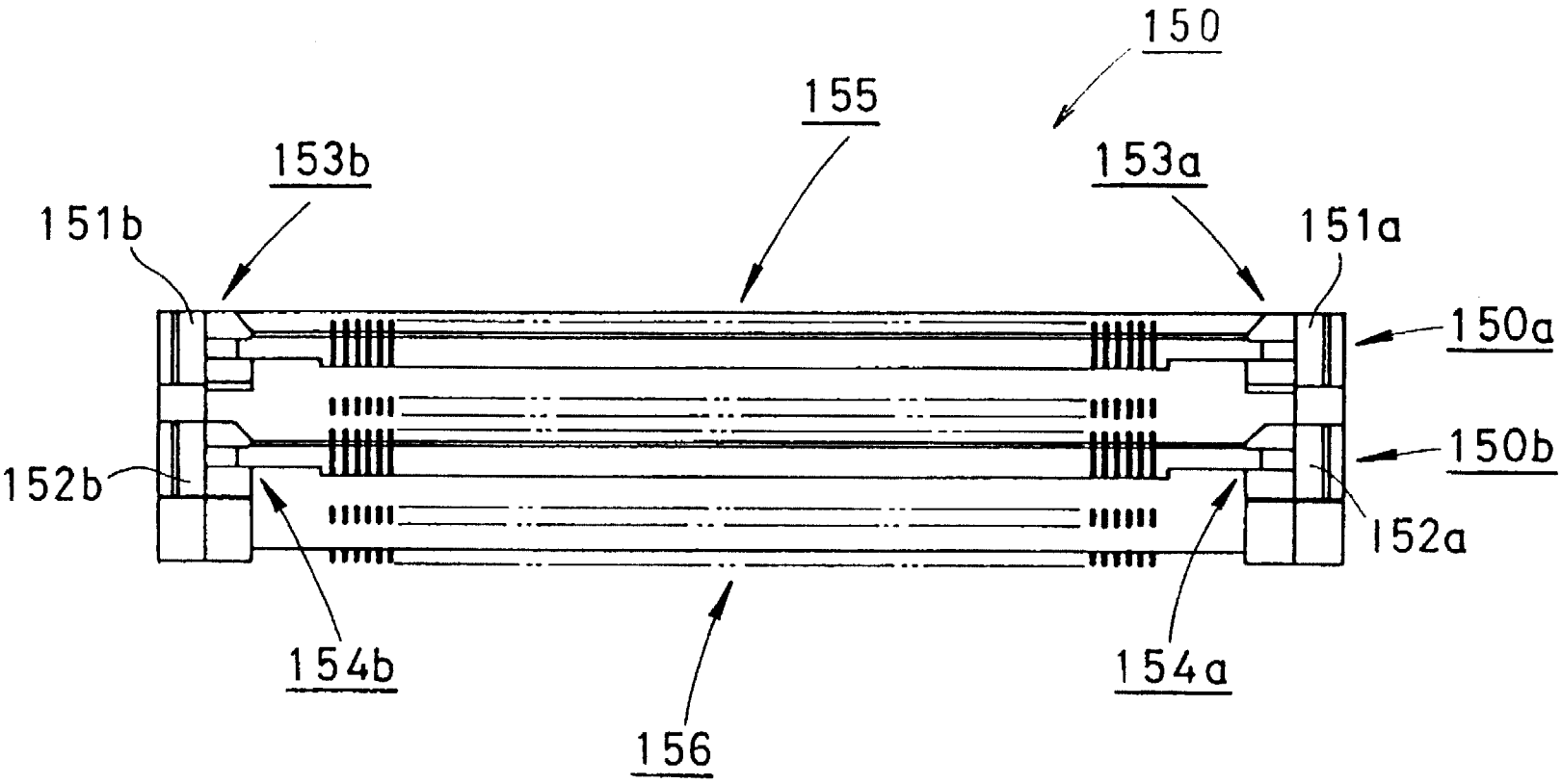
FIG. 20 is a schematic front view of the connector in Embodiment 5.
Figure 21:
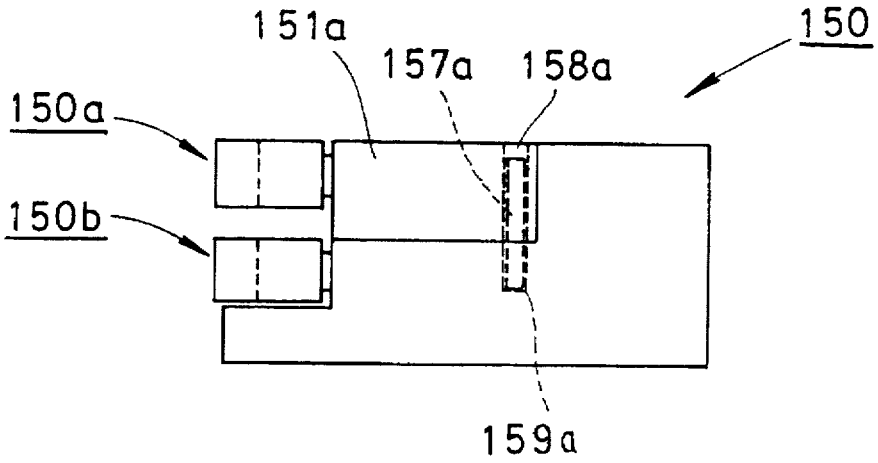
FIG. 21 is a diagram of the right side of FIG. 20.
Figure 22:
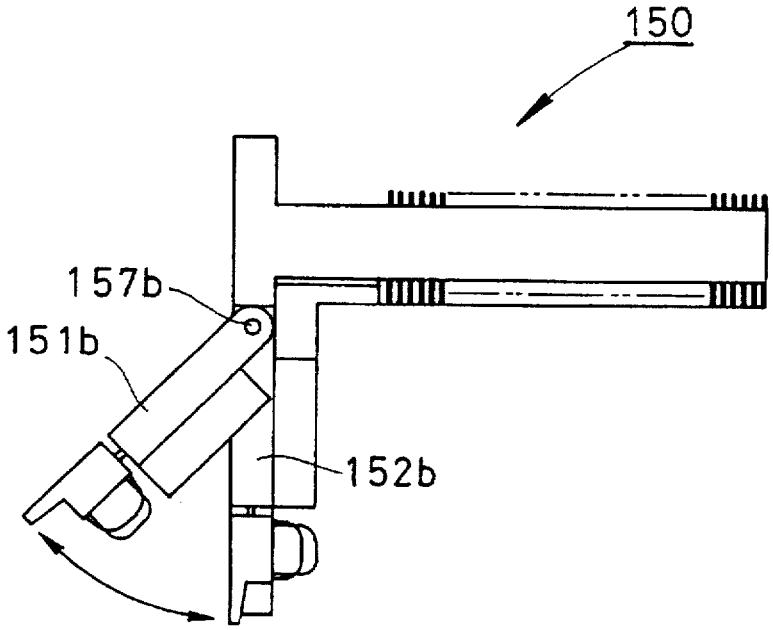
FIG. 22 is a partial plan view of FIG. 19.

FIG. 19 is a schematic plan view of a connector 150 in Embodiment 5, FIG. 20 is a schematic front view, FIG. 21, is a right side view, and FIG. 22 is a partial front view of FIG. 19.

In this connector 150, as shown in FIGS. 19 and 20, the housing units 150a and 150b (not shown in FIG. 19) are arranged in two stages above and below at locations that are aligned roughly planewise.

Arm components 151a and 151b for holding a module are arranged at both ends of the housing 150a located in the upper stage, while latch components 153a and 153b for engaging the sides of the module are located at the tips of the arm components.

Arm components 152a and 152b for holding a module are meanwhile arranged at both ends of the housing 150b located in the lower stage, while latch components 154a and 154b for engaging the sides of the module are located at the tips of the arm components. Connector electrode components 155 and 156 having the same structure as in Embodiment 1 are arranged in the widthwise direction of the housing 150a and 150b.

Moreover, the arm components 151a and 151b of the upper stage housing 150a are supported so that they are rotatable, respectively, counterclockwise and clockwise, by pivoting on support shafts 157a and 157b arranged perpendicular to the lower stage housing 150b.

The structures of the arm components and support shafts are described with reference to FIG. 21 using the right side arm component 151a and support shaft 157a as examples. In FIG. 21, a hole 158a is formed at one end of the arm component 151a. This hole 158a passes through one end of the arm component 151a. A hole 159a which does not pass through the main body component is meanwhile formed in the main body component of the connector 150. This hole 159a is formed in a location which faces the hole 158a when the arm component 151a is fitted into the connector 150. The arm 6omponent 151a and connector 150 are structured so that they are rotatable counterclockwise via the support shaft 157a embedded through holes 158a and 159a. Although not shown in FIG. 21, the arm component 151b on the opposite side is also structured so that it is rotatable clockwise by means of a hole 158b, a hole 159b, and a support shaft 157b.

The structures of the arm components and connector main body described above are not limited to the structures given in the preferred embodiment. Other structures may be adopted, provided that they can function in the same manner.

For example, the support shafts may be arranged so that they protrude downward at locations corresponding to the holes 158a and 158b of the arm components 151a and 151b, and the support shafts located in the arm components may be fitted into holes 159a and 159b formed in the connector 150, so that the arm components 151a and 151b are rotatably supported, pivoting on the support shafts thus described.

The operation of the arm component is described below with reference to FIG. 22 using the left side arm component 151b as an example. As shown in FIG. 22, the arm component 151b, when viewing the connector 150 from the front, is constructed so that it is rotatable clockwise, pivoting on the support shaft 157b, from a position (fixed position) aligned roughly planewise with the lower stage arm component 152b. The arm component 151a (not shown in figure) on the opposite side is also constructed so that it is rotatable counterclockwise, pivoting on the support shaft 157a. The arm components 151a and 151b thus open to the left and right, pivoting on the support shafts 157a and 157b, so that the upper stage housing 150a can be evacuated to a point where it will not interfere with the course along which a module is inserted into the lower stage housing 150b. The arm components 151a and 151b can also be constructed so that they rotate outwardly from the fixed positions shown in FIG. 19 but do not rotate inwardly.

The procedure for mounting modules in the housing units 150a and 150b of the connector 150 described above is described next with reference to FIG. 19 and 20.

First, the arm components 151a and 151b of the upper stage housing 150a are rotated counterclockwise and clockwise, respectively, by pivoting on the support shafts 157a and 157b, thus pushing the arm components out to the left and right and ensuring the course along which a module is inserted into the lower stage housing 150b. A first module (not shown in figure) is then inserted into the lower stage housing 150b, and the electrodes of the connector electrode component 156 are then brought into contact with the electrodes (not shown in figure) formed on both sides of the edge of the module. The module is then pushed down and is housed in the housing 150b. At this time, the latch components 154a and 154b engage the module on either side, and the module is thus mounted in the housing 150b.

Next, the arm components 151a and 151b of the upper stage housing 150a are returned to their original positions, resulting in a state allowing a module to be inserted into the upper stage housing 150a. A second module is then inserted into the upper housing 150a, and the electrodes of the connector electrode component 155 are then brought into contact with the electrodes (not shown in figure formed on both sides of the edge of the module. The module is then pushed down and is housed in the housing 150a. At this time, the latch components 153a and 153b engage the module on either side, and the module is thus mounted in the housing 150a.

With the connector in Embodiment 5, the upper stage housing 150a opens to the left and right when the module is inserted into the lower stage housing 150b, thus ensuring a course for a module to be inserted into the lower stage housing 150b. Thus, when the first module is inserted, the latch components 153a and 153b of the upper stage housing 150*a* do not interfere with the module, allowing the module to be readily inserted into the lower stage housing 150*b*.

Embodiment 6

Figure 23:
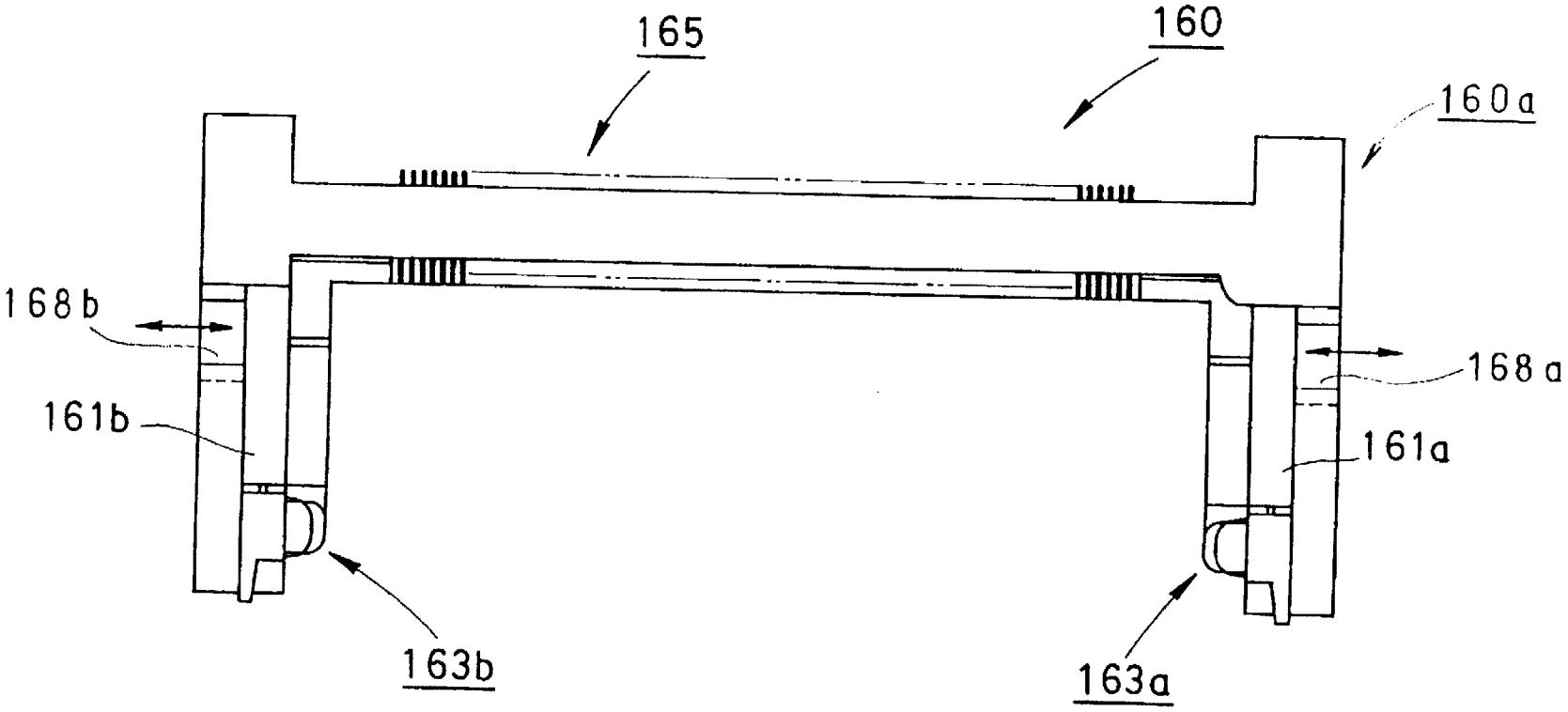
FIG. 23 is a schematic plan view of the connector in Embodiment 6.
Figure 24:
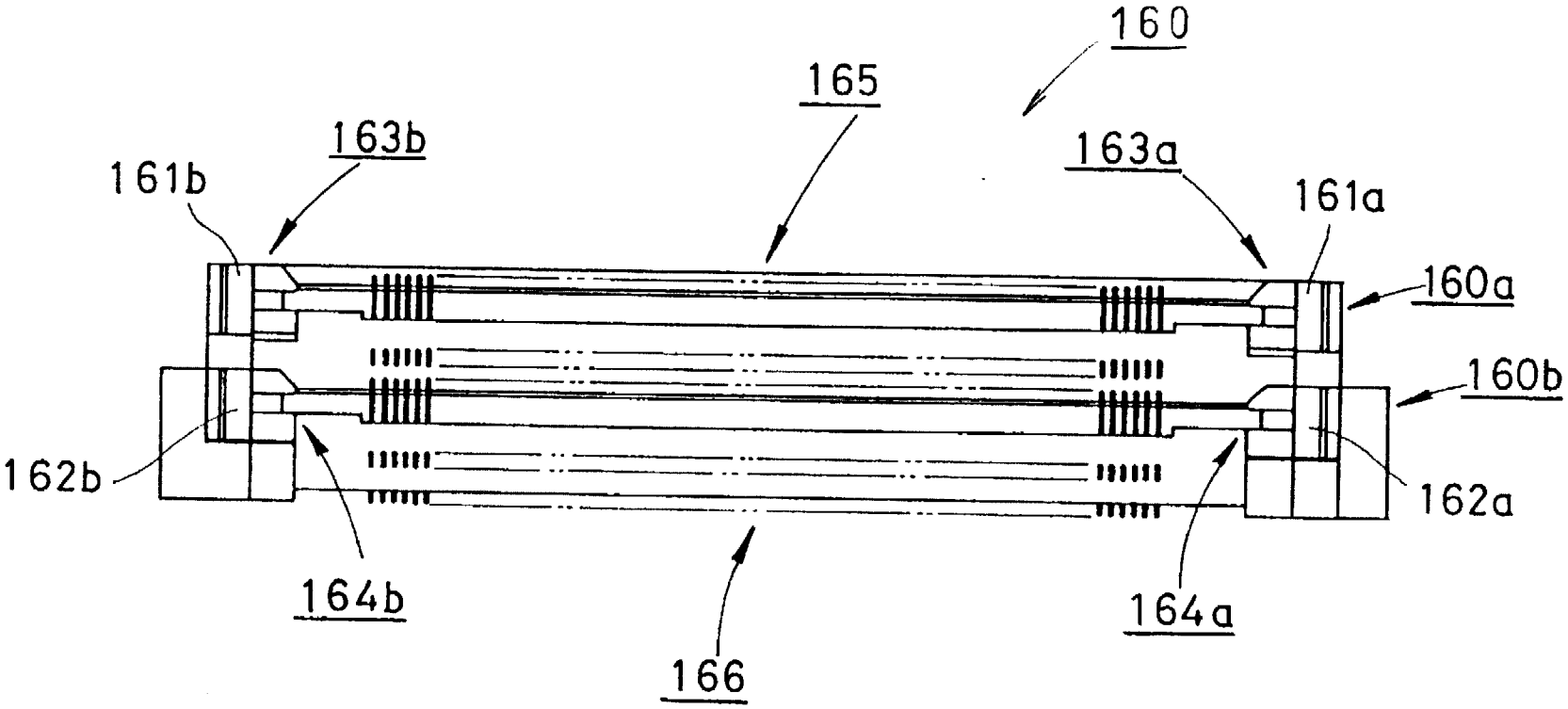
FIG. 24 is a schematic front view of the connector in Embodiment 6.
Figure 25:
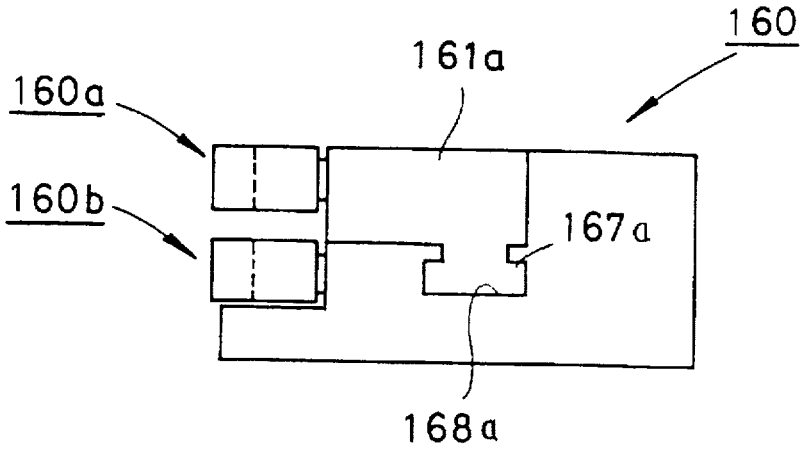
FIG. 25 is a diagram of the right side of FIG. 24.
Figure 26:
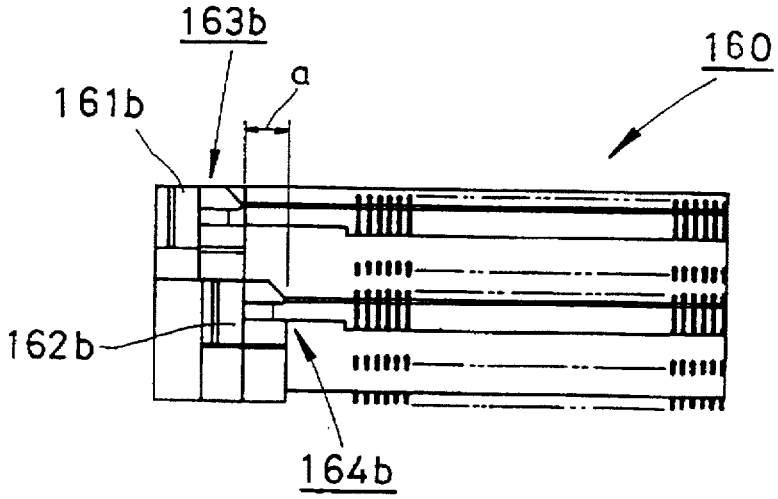
FIG. 26 is a partial plan view of FIG. 24.

FIG. 23 is a schematic plan view of a connector 160 in Embodiment 6, FIG. 24 is a schematic front view, FIG. 25, is a right side view, and FIG. 26 is a partial front view of FIG. 24.

In this connector 160, as shown in FIGS. 23 and 24, the housing units 160*a* and 160*b* (not shown in FIG. 23) are arranged in two stages above and below at locations that are aligned roughly planewise.

Arm components 161*a* and 161*b* for holding a module are arranged at both ends of the housing 160*a* located in the upper stage, while latch components 163*a* and 163*b* for engaging the sides of the module are located at the tips of the arm components.

Arm components 162*a* and 162*b* for holding a module are meanwhile arranged at both ends of the housing 160*b* located in the lower stage, while latch components 164*a* and 164*b* for engaging the sides of the module are located at the tips of the arm components. Connector electrode components 165 and 166 having the same structure as in Embodiment 1 are arranged in the widthwise direction of the housing 160*a* and 160*b*.

Moreover, the arm components 161*a* and 161*b* arranged at both ends in the upper stage housing 160*a* are supported so that they are movable parallel to the longitudinal direction of the lower stage housing 160*b*. The structure of the arm component is described with reference to FIG. 25 using the right side arm component 161*a* as an example. In FIG. 25, a roughly convex protrusion 167*a* is formed at one end of the arm component 161*a*, and a roughly concave groove 168*a* for engaging the protrusion 167*a* is formed in the main body of the connector 160. The protrusion 167*a* of the arm component 161*a* thus is fitted into the groove 168*a* of the connector 160 main body, so that the arm component 161*a* is movably supported horizontally with respect to the connector 160 main body. Although not shown in FIG. 25, the arm component 161*b* on the opposite side is also structured so that a protrusion 167*b* is horizontally movable along a groove 168*b*.

FIG. 23 depicts the arm components 161*a* and 161*b* in fixed positions. The structures of the arm components and connector main body described above are not limited to the structures given in the preferred embodiment. Other structures may be adopted, provided that they can function in the same manner.

The operation of the arm component is described below with reference to FIG. 26 using the left side arm component 161*b* as an example. As shown in FIG. 26, when the arm component 161*b* is horizontally pulled outward from a position (fixed position) aligned roughly planewise with the lower stage arm component 162*b*, the arm component 161*a* moves a given distance (a). Similarly, when the arm 161*a* on the opposite side (not shown in figure) is horizontally pulled outward (right side), it moves a given distance (a). The arm components 161*a* and 161*b* are thus pulled out to the left and right, allowing the upper stage housing 160*a* to be evacuated to a point where it will not interfere with the course along which a module is inserted into the lower stage housing 160*b*. The arm components 161*a* and 161*b* can also be constructed so that they move outwardly from the fixed positions shown in FIG. 23 but do not move inwardly.

The procedure for mounting modules in the housing 160*a* and 160*b* of the connector 160 described above is described next with reference to FIGS. 23 and 24.

First, the arm components 161*a* and 161*b* of the upper stage housing 160*a* are pulled out to the left and right, respectively, thus ensuring the course along which a module is inserted into the lower stage housing 160*b*. A first module (not shown in figure) is then inserted into the lower stage housing 160*b*, and the electrodes of the connector electrode component 166 are then brought into contact with the electrodes (not shown in figure) formed on both sides of the edge of the module. The module is then pushed down and is housed in the housing 160*b*. At this time, the latch components 164*a* and 164*b* engage the module on either side, and the module is thus mounted in the housing 160*b*.

Next, the arm components 161*a* and 161*b* of the upper stage housing 160*a* are returned to their fixed positions, resulting in a state allowing a module to be inserted into the upper stage housing 160*a*. A second module is then inserted into the upper housing 160*a*, and the electrodes of the connector electrode component 165 are then brought into contact with the electrodes (not shown in figure) formed on both sides of the edge of the module. The module is then pushed down and is housed in the housing 160*a*. At this time, the latch components 163*a* and 163*b* engage the module on either side, and the module is thus mounted in the housing 160*a*.

With the connector in Embodiment 6, when a module is inserted into the lower stage housing 160*b*, the arm components of the upper stage housing 160*a* open in the direction running horizontal to the course along which the module is inserted, thus ensuring the course along which a module is inserted into the lower stage housing 160*b*. Thus, when the first module is inserted, the latch components 163*a* and 163*b* of the upper stage housing 160*a* do not interfere with the module, allowing the module to be readily inserted into the lower stage housing 160*b*.

Embodiment 7

Figure 27:
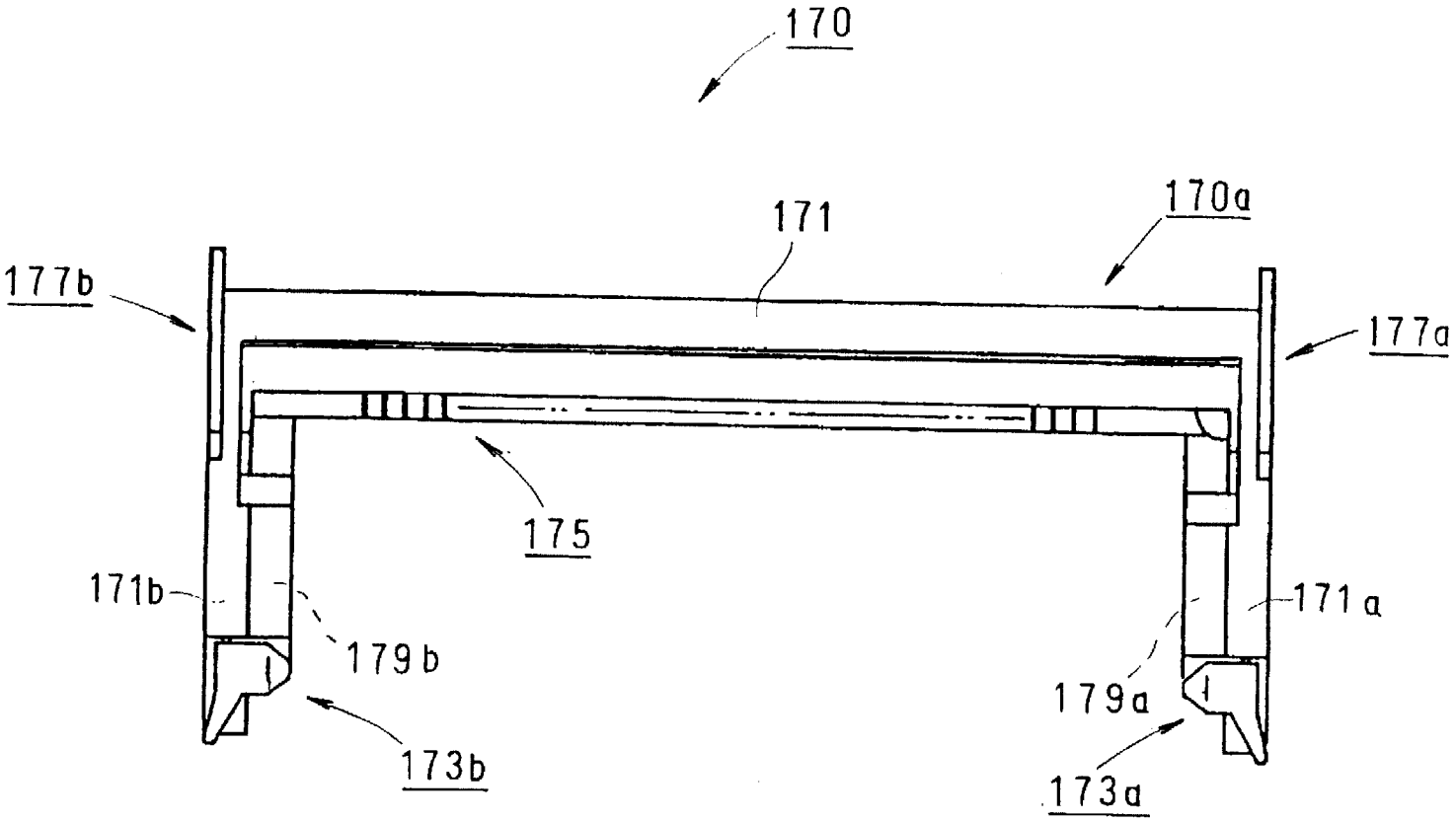
FIG. 27 is a schematic plan view of the connector in Embodiment 7.
Figure 28:
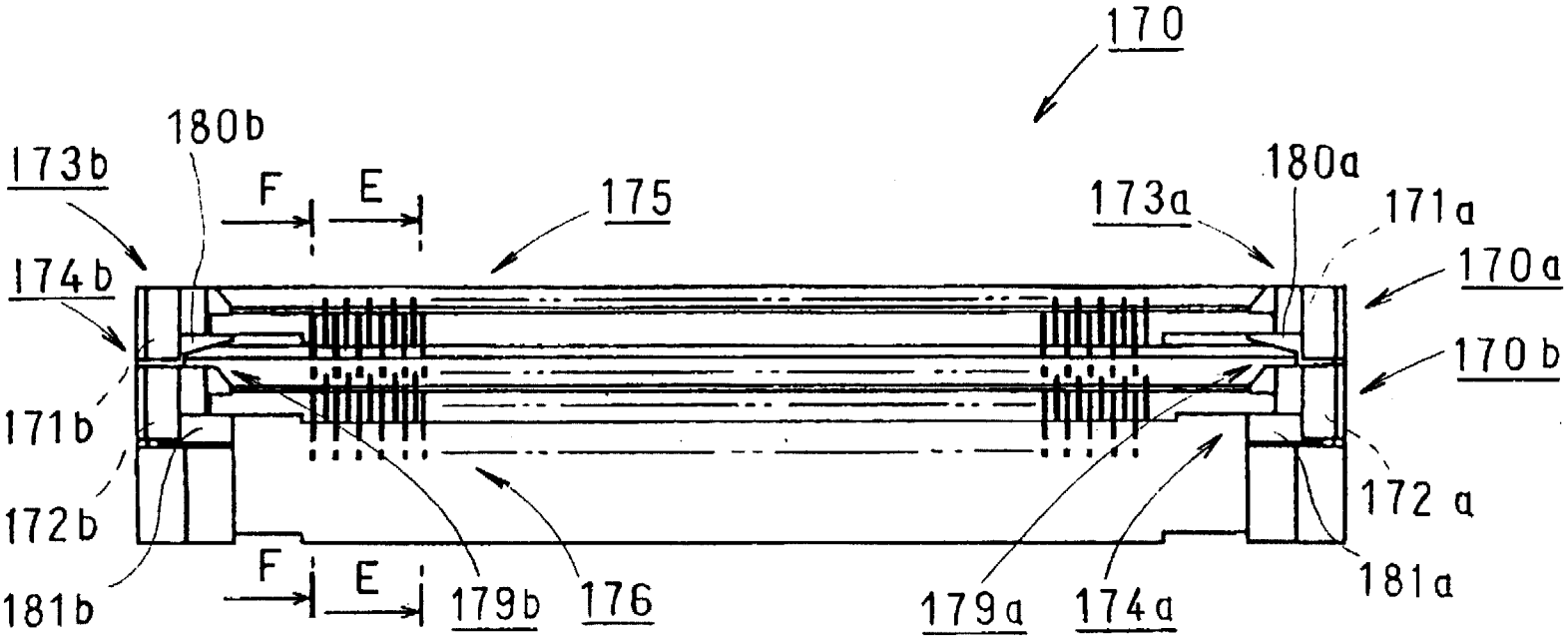
FIG. 28 is a schematic front view of the connector in Embodiment 7.
Figure 29:
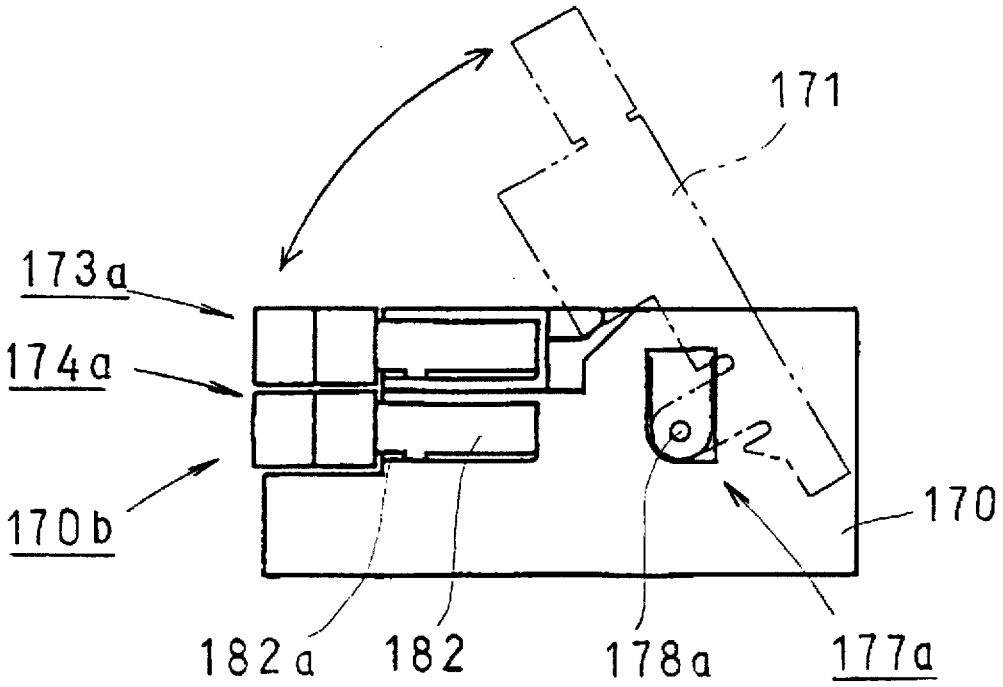
FIG. 29 is a diagram of the right side of FIG. 27.
Figure 30:
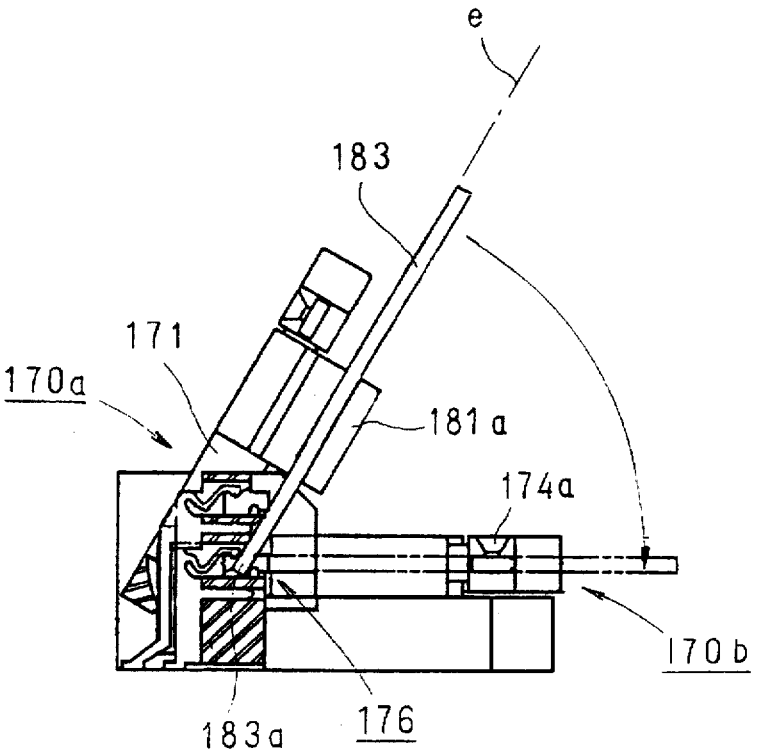
FIG. 30 is a cross section along line E—E in FIG. 28.
Figure 31:
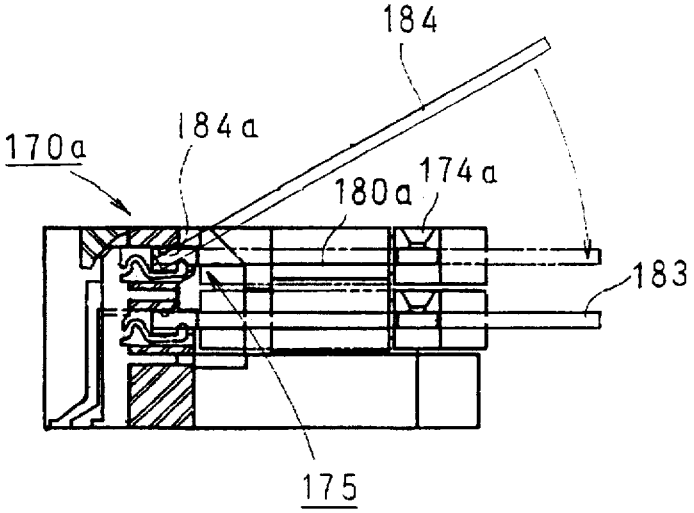
FIG. 31 is a cross section along line F—F in FIG. 28.

FIG. 27 is a schematic plan view of a connector 170 in Embodiment 7, FIG. 28 is a schematic front view, FIG. 29, is a right side view, FIG. 30 is a cross section along line E—E in FIG. 28, and FIG. 31 is a cross section along line F—F in FIG. 28.

In this connector 170, as shown in FIGS. 27 and 28, the housing units 170*a* and 170*b* (not shown in FIG. 27) are arranged in two stages above and below at locations that are aligned roughly planewise.

A roughly [ shaped module-holding frame 171 is rotatably supported by a hinge mechanism described below in the housing 170*a* located in the upper stage. Arm components 171*a* and 171*b* for holding a module are arranged at both ends of this module-holding frame 171, while latch components 173*a* and 173*b* for engaging the sides of the module are located at the tips of the arm components.

Arm components 172*a* and 172*b* for holding a module are meanwhile arranged at both ends of the housing 170*b* located in the lower stage, while latch components 174*a* and 174*b* for engaging the sides of the module are located at the tips of the arm components.

Connector electrode components 175 and 176 having the same structure as in Embodiment 1 are arranged in the widthwise direction of the housing 170*a* and 170*b*.

One end of the module-holding frame 171 described above is rotatably supported in the connector 170 by a support shaft 178*a* of a hinge component 177 located in the connector 170. Although not shown in FIG. 29, a hinge component 177*b* having the same structure is also arranged on the opposite side of the connector 170, and the other end of the module-holding frame 171 is thus rotatably supported. That is, the module-holding frame 171 is rotatably supported by hinge components 177*a* and 177*b* located at both ends of the connector 170. As shown in FIG. 29, this allows the arm component 171*a* (and 171*b* (not shown in figure) on the opposite side) to rotate clockwise, pivoting on the support shaft 178*a* of the hinge component 177*a*, so that the upper stage housing 170*a* can be evacuated to a point where it will not interfere with the course along which a module is inserted into the lower stage housing 170*b*.

The structures of the arm components and connector main body described above are not limited to the structures given in the embodiment. Other structures may be adopted, provided that they can function in the same manner. For example, support shafts may be provided in the arm components 171*a* and 171*b*, holes may be formed in locations corresponding to the support shafts of the connector 170, and the support shafts located in the arm components may be fitted into the holes formed in the connector, so that the arm components 171*a* and 171*b* are rotatably supported, pivoting on the support shafts.

As shown in FIG. 28, meanwhile, module-housing frames 179*a* and 179*b* are arranged in the arm components 171*a* and 171*b* of the module-holding frame 171. These module-housing frames 179*a* and 179*b* are divided into two stages above and below, the module mounted in the upper stage housing 170*a* is housed in first housing frames 180*a* and 180*b*, and the module mounted in the lower stage housing 170*b* is housed in second housing frames 181*a* and 181*b*.

Hook-shaped protrusions not shown in the figure are formed on the outside the second housing frames 181*a* and 181*b*. These hook-shaped protrusions are constructed so as to engage notches in the plate springs of the latch components 174*a* and 174*b* when a module is completely mounted in the lower stage housing 170*b*. The expression "notch in the plate spring" refers to a notch 182*a* in a plate spring 182 of the latch component 174*a*, as shown in FIG. 29, for example. Although not shown in FIG. 29, a similarly shaped notch is formed in the plate spring of the latch component 174*b* located on the opposite side. When a module is completely mounted in the lower stage housing 170*b*, the hook-shaped protrusions located on the outside of the second housing frames 181*a* and 181*b* are engaged by the notches in the plate springs, and the second housing frames 181*a* and 181*b* are fixed in the connector 170. The arm components 171*a* and 171*b* of the upper stage housing 170*a* integrally formed with the module-holding frame 171 are thus secured at the same time.

The procedure for mounting modules in the housing 170*a* and 170*b* of the connector 170 described above is described next with reference to FIGS. 30 and 31. Although the support shaft 178*a* is not shown in FIGS. 30 and 31, the description here will be given as if the support shaft 178*a* is shown in FIGS. 30 and 31.

First, as shown in FIG. 30, the module-holding frame 171 of the upper stage housing 170*a* is rotated counterclockwise, pivoting on the support shaft (178*a*), thus ensuring the course along which a module is inserted into the lower stage housing 170*b*. A first module 183 is then inserted along a given course (e) and is housed in the second housing frame 181*a* (and 181*b* (not shown in figure) on the opposite side) of the upper stage housing 170*a*. The electrodes of the connector electrode 176 are then brought into contact with the electrodes (not shown in figure) formed on both sides of the edge 183*a* of the module 183. The module 183 is then pushed down from this state and is housed in the lower stage housing 170*b*. At this time, the latch component 174*a* (and 174*b* (not shown in figure) on the opposite side) engages the module 183 on either side, and the module is thus completely mounted in the lower stage housing 170*b*. A point to be considered here is that the first module 183 is mounted in the lower stage housing 170*b* but is housed in the second housing frame 181*a* (and 181*b* (not shown in figure) on the opposite side) of the upper stage housing 170*a* when inserted into the connector 170.

When the module 183 has been engaged on either side by the latch component 174*a* (and 174*b* (not shown in figure) on the opposite side) in the lower stage, the module 183 is mounted inside the lower stage housing 170*b*. At this time, the hook-shaped protrusion (not shown in figure) located on the outside of the second housing frame 181*a* (and 181*b* (not shown in figure) on the opposite side) is engaged by the latch component 174*a* (and 174*b* (not shown in figure) on the opposite side), so that the second housing frames 181*a* and 181*b* are secured to the connector 170.

As shown in FIG. 31, a second module 184 is then inserted into the upper stage housing 170*a*, and the connector electrode 175 is brought into contact with the electrodes (not shown in figure) formed at the end 184*a* of the module 184. The module 184 is then pushed down in the direction indicated by the arrow and is housed in the upper stage housing 170*a*. At this time, the latch component 174*a* (and 174*b* (not shown in figure) on the opposite side) engages the module 184 on either side, and the module 184 is thus completely mounted in the upper stage housing 170*a*. This second module 184 is housed in the first housing frame 180*a* (and 180*b* (not shown in figure) on the opposite side) of the upper stage housing 170*a*.

With the connector 170 in Embodiment 7, when the module 183 is inserted into the lower stage housing 170*b*, the upper stage housing 170*a* opens upward, thus ensuring the course along which the module is inserted into the lower stage housing 170*b*. Thus, when the first module 183 is inserted, the latch component 174*a* (and 174*b* (not shown in figure) on the opposite side) of the upper stage housing 170*a* does not interfere with the module 183, allowing the module 183 to be readily inserted into the lower stage housing 170*b*.

In the connectors of Embodiments 2 through 7 described above, when the module was inserted into the lower stage housing, the upper stage housing or arm components were evacuated, and after the module was mounted in the lower stage housing, the upper stage housing or arm components were manually returned to their original positions, but the upper stage housing or arm components can be devised so that they automatically return to their fixed positions when a module has been inserted into the lower stage housing.

The embodiments were described above using examples in which the housing was arranged in two stages above and below, but the electrical connector pertaining to the present invention can be applied in cases where the housing is superposed in three or more stages.

The electrical connector pertaining to the first of the inventions can be applied not only as a connector for memory modules such as DIMMs but also can generally be applied for connectors involving the insertion of interfaces used when various peripheral devices are connected, or other printed circuit boards.

As described above, the electrical connector pertaining to the first of the inventions is constructed in such a way that the housing on the upper stage side among the housing arranged in at least two stages is established in a position, or is evacuated to a position, where it will not interfere with the course along which an extension board is inserted into the housing on the lower stage side. As such, there is no danger that the extension board which is to be inserted will strike the tip of the housing on the upper stage side when the extension board is inserted into the housing on the lower stage side, thus allowing the extension board to be readily inserted on the lower stage side.

The housing can accordingly be arranged in two stages above and below without increasing the thickness of the main body, thus allowing an electrical connector which addresses the need for the extension of various functions and the design of thinner devices to be offered.

An embodiment of the electrical connector pertaining to the second of the inventions is described below. Here, the embodiment (Embodiment 8) involves the application of the electrical connector pertaining to the second of the inventions as a connector for DIMMs.

Embodiment 8

Figure 32:
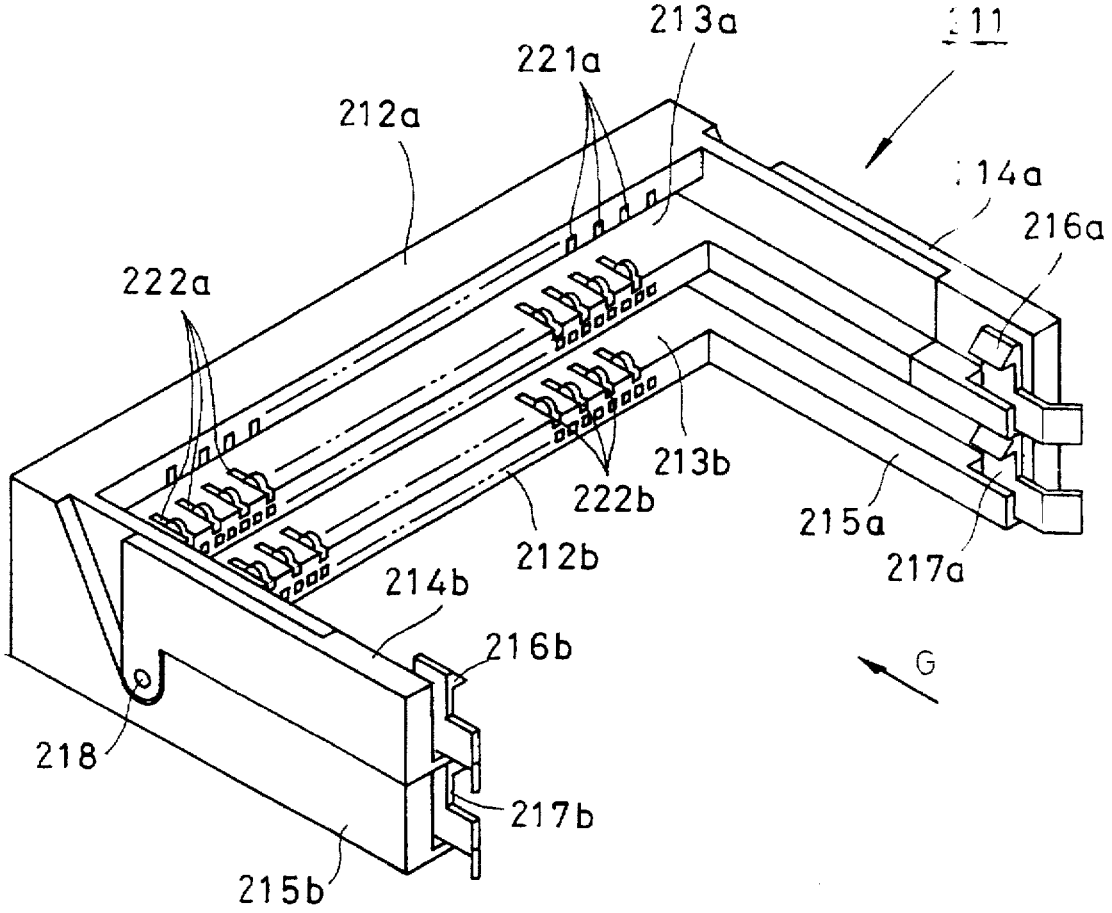
FIG. 32 is a schematic perspective view of a DIMM connector in Embodiment 8.

FIG. 32 is a schematic perspective view of a connector for a DIMM, depicting a structure with the housing arranged in two stages above and below.

In FIG. 32, the connector 211 is a connector for connecting two modules (not shown in figure) and is provided with housing 212*a* and 212*b* arranged in two stages above and below. A concave groove 213*a* for receiving a module is formed along the longitudinal direction of the housing 212*a*, and arm components 214*a* and 214*b* for holding a module are arranged at both ends. Similarly, a concave groove 213*b* for receiving a module is formed along the longitudinal direction of the housing 212*b*, and arm components 215*a* and 215*b* for holding a module are arranged at both ends.

Latch components 216*a* and 216*b* for engaging the sides of a module that is inserted are arranged facing each other at the tips of the arm components 214*a* and 214*b*, and latch components 217*a* and 217*b* for engaging the sides of a module that has been inserted are similarly arranged facing each other at the tips of the arm components 215*a* and 215*b*. These latch components are constructed of resilient spring members or the like, and are always inwardly energized. This allows the arm components 214*a* and 214*b* to rotate upwards, pivoting on a support shaft 218, so that the arm components 214*a* and 214*b* can be evacuated to a point where they will not interfere with the course along which a module is inserted into the lower stage housing 212*b*. The operation of the latch components at the time a module is inserted is the same as that shown in Embodiment 3 above, and the description will therefore be omitted here.

Figure 33:
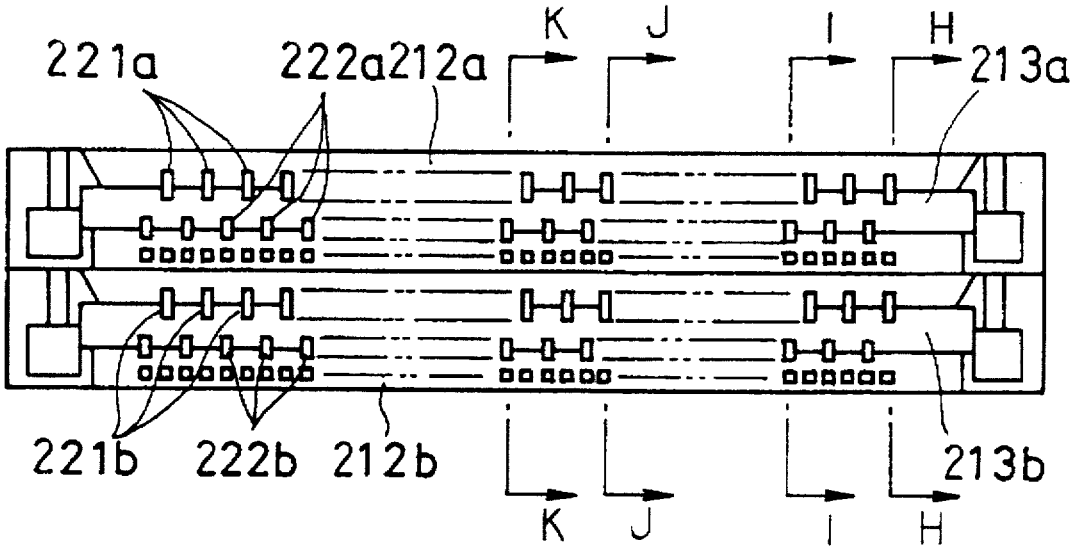
FIG. 33 is a schematic front view along arrow G in FIG. 32.

As shown in FIG. 33, which is a view along arrow G in FIG. 32, first movable terminals 221*a* and second movable terminals 222*a* are alternately arranged at specified intervals in the groove 213*a* of the housing 212*a*. First movable terminals 221*b* and second movable terminals 222*b* are alternately arranged at specified intervals in the groove 213*b* of the housing 212*b*.

The structure of the first terminals 221*a* and 221*b* and of the second movable terminals 222*a* and 222*b* is described next.

Figure 34:
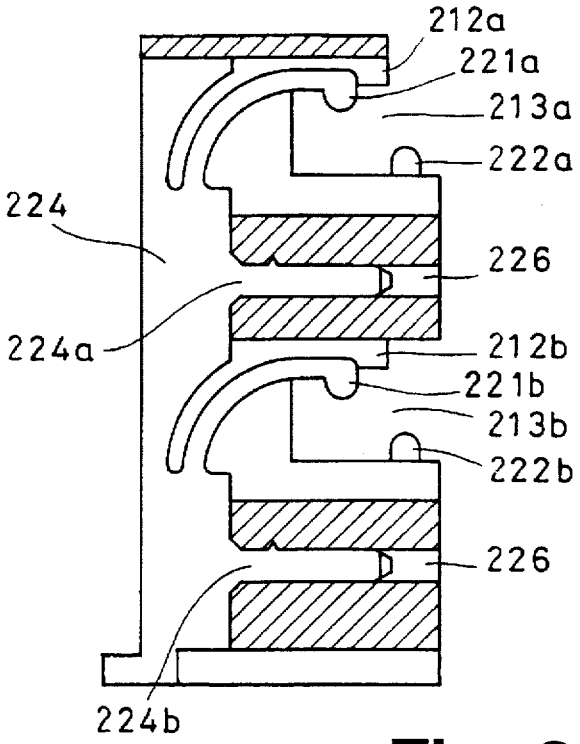
FIG. 34 is a schematic cross section corresponding to cross section H—H in FIG. 33.

FIG. 34 is a schematic cross section corresponding to cross section H—H in FIG. 33, depicting the electrode structure of the first movable terminals 221*a* and 221*b*. In FIG. 34, the first movable terminals 221*a* located in the groove 213*a* of the upper stage housing 212*a* and the first movable terminals 221*b* located in the groove 213*b* of the lower stage housing 212*b* are terminals that are identically located planewise. These two movable terminals are internally integrally formed in the form of a first connector electrode 224.

Fixing pins 224*a* and 224*b* for fixing the electrode main unit inside the housing are formed above and below in the first connector electrode 224. When the connector electrode 224 is mounted inside the housing 212*a* and 212*b*, the connector electrode 224 is inserted from behind the housing 212*a* and 212*b*, and the fixing pins 224*a* and 224*b* are fitted, respectively, into upper and lower pin holes 226, so that the connector electrode 224 can be fixed inside the housing 212*a* and 212*b*.

Figure 35:
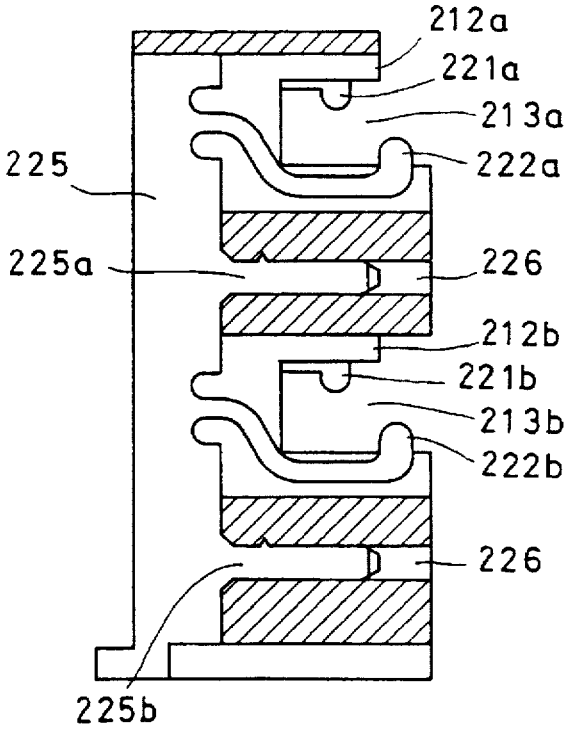
FIG. 35 is a schematic cross section corresponding to cross section I—I in FIG. 33.

FIG. 35 is a schematic cross section corresponding to cross section I—I in FIG. 33, depicting the electrode structure of the second movable terminals 22*a* and 22*b*. In FIG. 35, the second movable terminals 222*a* located in the groove 213*a* of the upper stage housing 212*a* and the second movable terminals 222*b* located in the groove 213*b* of the lower stage housing 212*b* are terminals that are identically located planewise. These two movable terminals are internally integrally formed in the form of a second connector electrode 225.

Fixing pins 225*a* and 225*b* for fixing the electrode main units inside the housing are also formed above and below in the second connector electrode 225. When the connector electrode 225 is mounted inside the housing 212*a* and 212*b*, the connector electrode 225 is inserted from behind the housing 212*a* and 212*b*, and the fixing pins 225*a* and 225*b* are fitted, respectively, into the upper and lower pin holes 226, so that the connector electrode 225 can be fixed inside the housing 212*a* and 212*b*.

The movable terminals located inside the housing include control electrodes for the exchange of control signals between the modules mounted in each of the housing units. In the movable terminals functioning as control electrodes, upper and lower stage movable terminals identically located planewise are formed separately for each stage of the housing.

The structure of the movable terminals separately formed in upper and lower stages is described next. The separately formed movable terminals are arranged in two groups roughly near the center of each housing unit.

Figure 36:
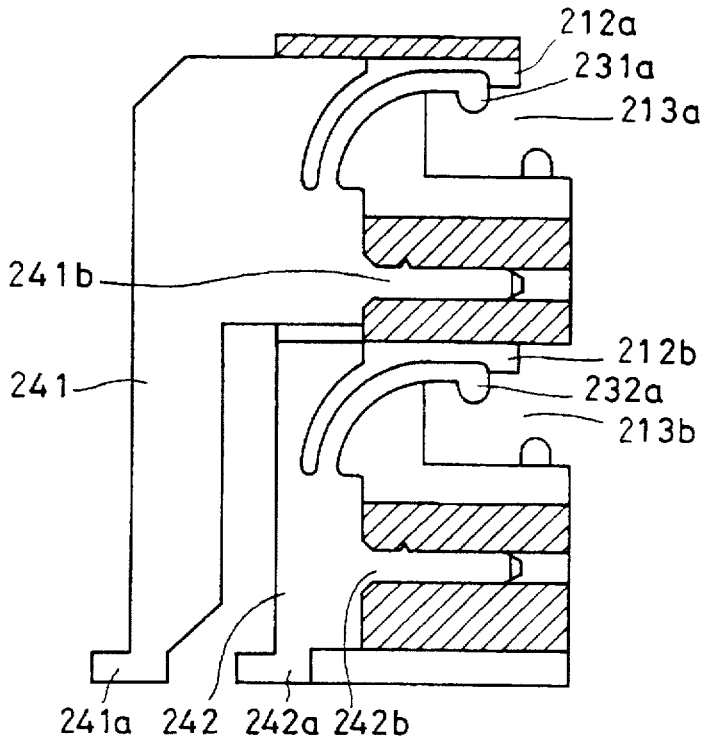
FIG. 36 is a schematic cross section corresponding to cross section J—J in FIG. 33.

FIG. 36 is a schematic cross section corresponding to cross section J—J in FIG. 33, depicting the electrode structure of third movable terminals 231*a* arranged inside the upper stage housing 212*a* and of third movable terminals 232*a* arranged inside the lower stage housing 212*b*. The third movable terminals 231*a* are formed in the form of a third connector electrode 241, arranged inside the groove 213*a* of the upper stage housing 212*a*. The third movable terminals 232*a* are formed in the form of a fourth connector electrode 242, arranged inside the groove 213*b* of the lower stage housing 212*b*. Contact terminals 241*a* and 242*a* for connection with the motherboard (not shown in figure) are formed, respectively, in the third connector electrode 241 and fourth connector electrode 242.

Fixing pins 241*b* and 242*b* for fixing the electrode main units inside the housing are integrally formed, respectively, in the third connector electrode 241 and fourth connector electrode 242, and are fixed inside the housing in the same manner as the connector electrodes shown in FIGS. 34 and 35.

Figure 37:
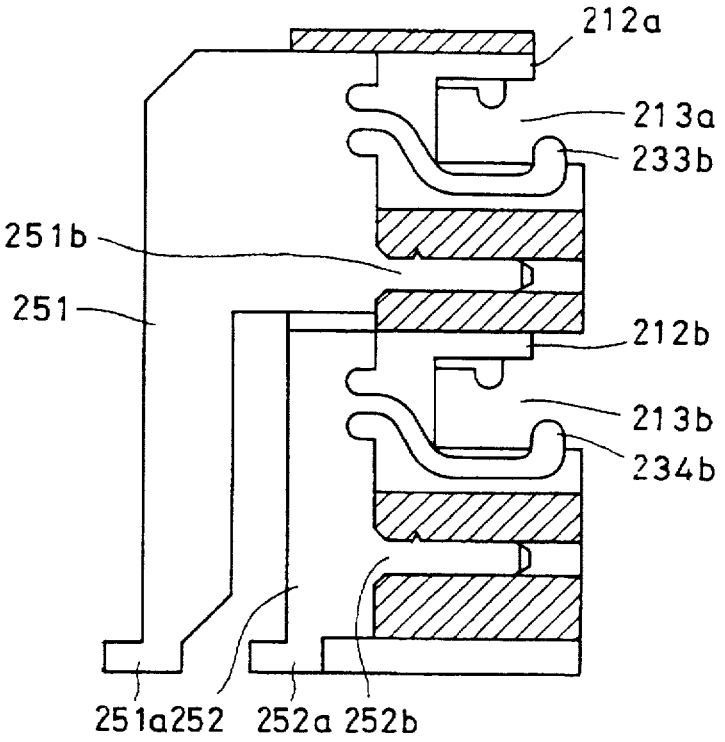
FIG. 37 is a schematic cross section corresponding to cross section K—K in FIG. 33.

FIG. 37 is a schematic cross section corresponding to cross section K—K in FIG. 33, depicting the electrode structure of fourth movable terminals 233*b* arranged inside the upper stage housing 212*a* and of fourth movable terminals 234*b* arranged inside the lower stage housing 212*b*. The fourth movable terminals 233*b* are formed in the form of a fifth connector electrode 251, arranged inside the groove 213*a* of the upper stage housing 212*a*. The fourth movable terminals 234*b* are formed in the form of a sixth connector electrode 252, arranged inside the groove 213*b* of the lower stage housing 212*b*. Contact terminals 251*a* and 252*a* for connection with the motherboard (not shown in figure) are formed, respectively, in the fifth connector electrode 251 and sixth connector electrode 252.

Fixing pins 251*b* and 252*b* for fixing the electrode main units inside the housing are integrally formed, respectively, in the fifth connector electrode 251 and sixth connector electrode 252, and are fixed inside the housing in the same manner as the connector electrodes shown in FIGS. 34 and 35.

The procedure for mounting modules inside the upper and lower housing units in the connector 211 described above is described next with reference to FIGS. 38 and 39, which correspond to FIGS. 34 and 35.

Figure 38:
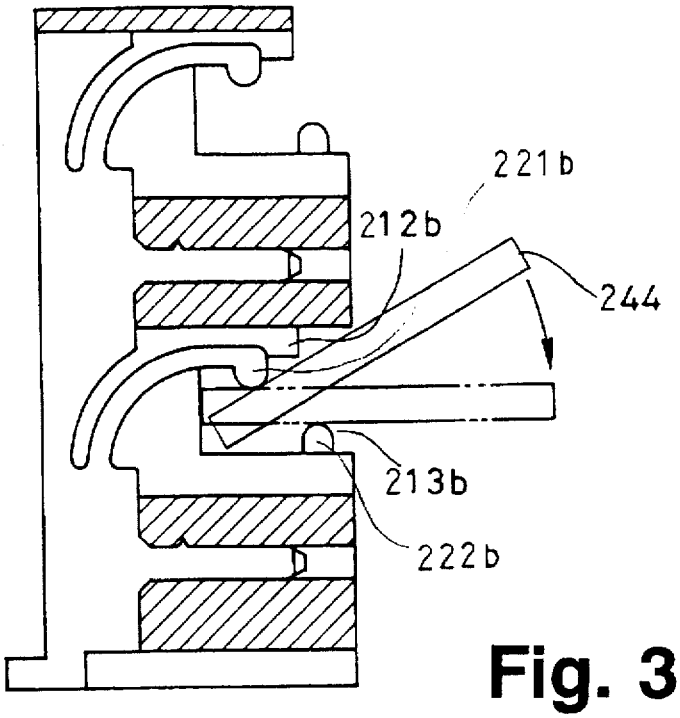
FIG. 38 is a schematic cross section depicting a connector when a module is mounted.

First, the arm components 214*a* and 214*b* of the upper stage housing 212*a* as shown in FIG. 32 are pushed up, by pivoting on the support shaft 218, thus ensuring the course along which a module is inserted into the lower stage housing 212*b*. Then, as shown in FIG. 38, a first module 244 is inserted from an oblique direction into the groove 213*b* of the lower stage housing 212*b*, and the module 244 is rotated in the direction indicated by the arrow and is housed inside the housing 212*b*. At this time, the latch components 217*a* and 217*b* shown in FIG. 32 engage the module 244 on either side, and the module 244 is mounted in the housing 212*b*. At the same time, the first movable terminals 221*b* and the second movable terminals 222*b* in the housing 212*b* are electrically connected by resilient contact with the electrode terminals (not shown in figure) of the module 244. At this time, the module 244 is fixed in a pressed state from above and below by the first movable terminals 221*b* and second movable terminals 222*b*.

Figure 39:
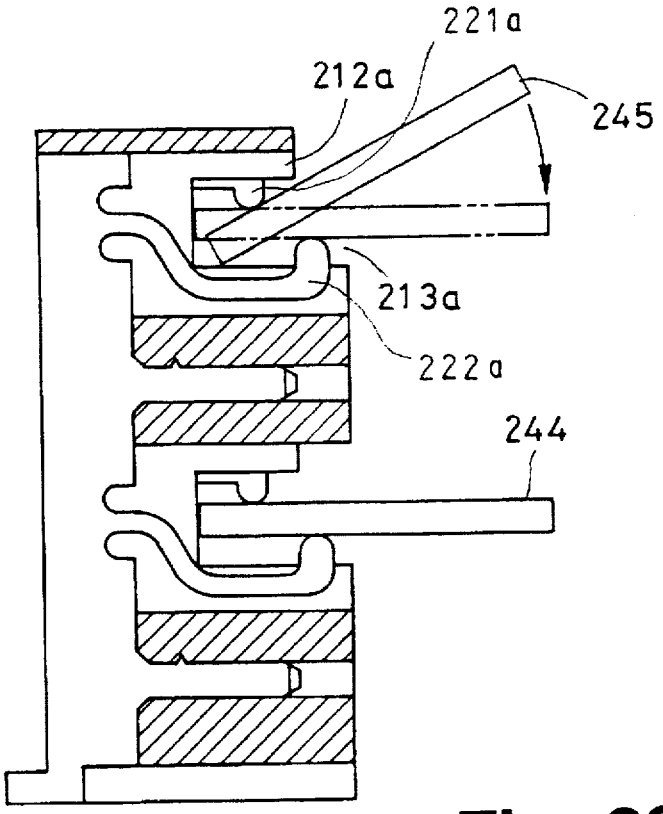
FIG. 39 is a schematic cross section depicting a connector when a module is mounted.
Figure 40:
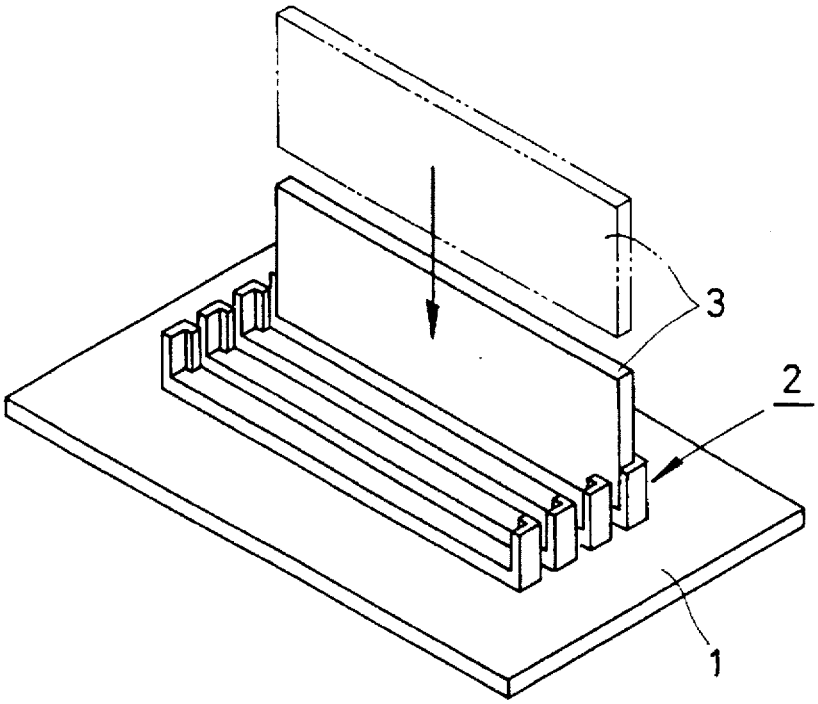
Fig. 40 PRIOR ART
FIG. 40 is a schematic perspective view depicting the structure of a conventional electrical connector for DIMMs.
Figure 41:
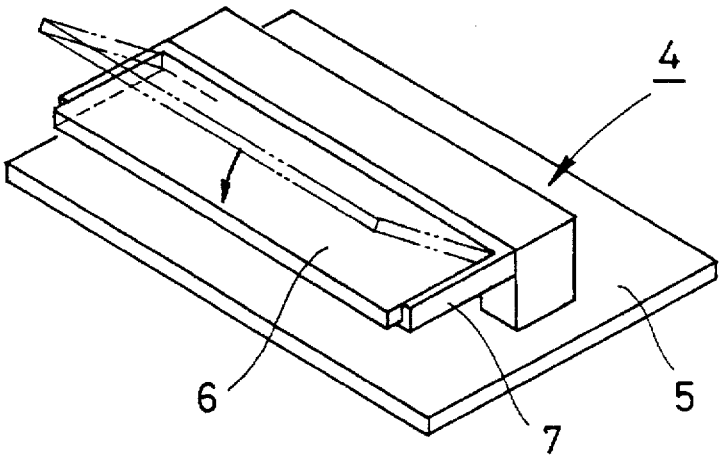
Fig. 41 PRIOR ART
FIG. 41 is a structural diagram of a connector arranged roughly parallel to the motherboard.
Figure 42:
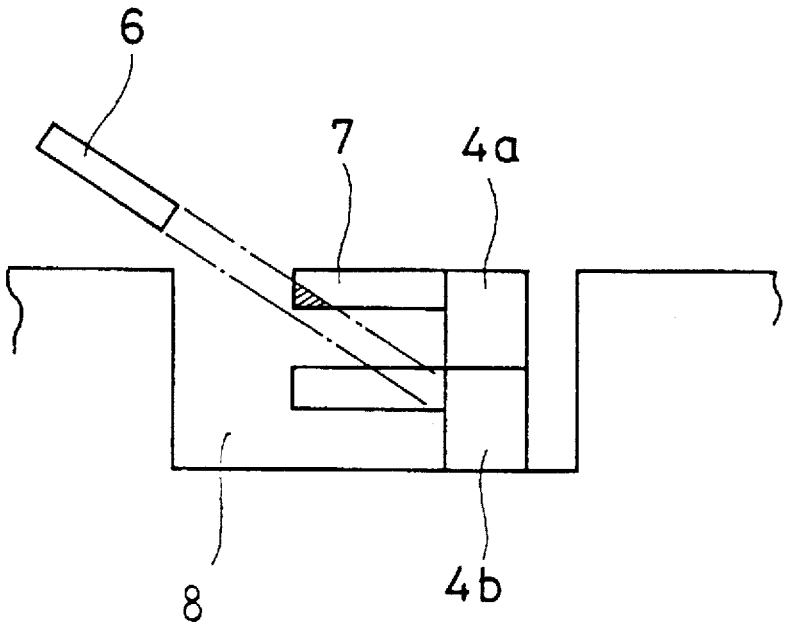
Fig. 42 PRIOR ART
FIG. 42 is a structural diagram of housing arranged in two stages above and below.
Figure 43:
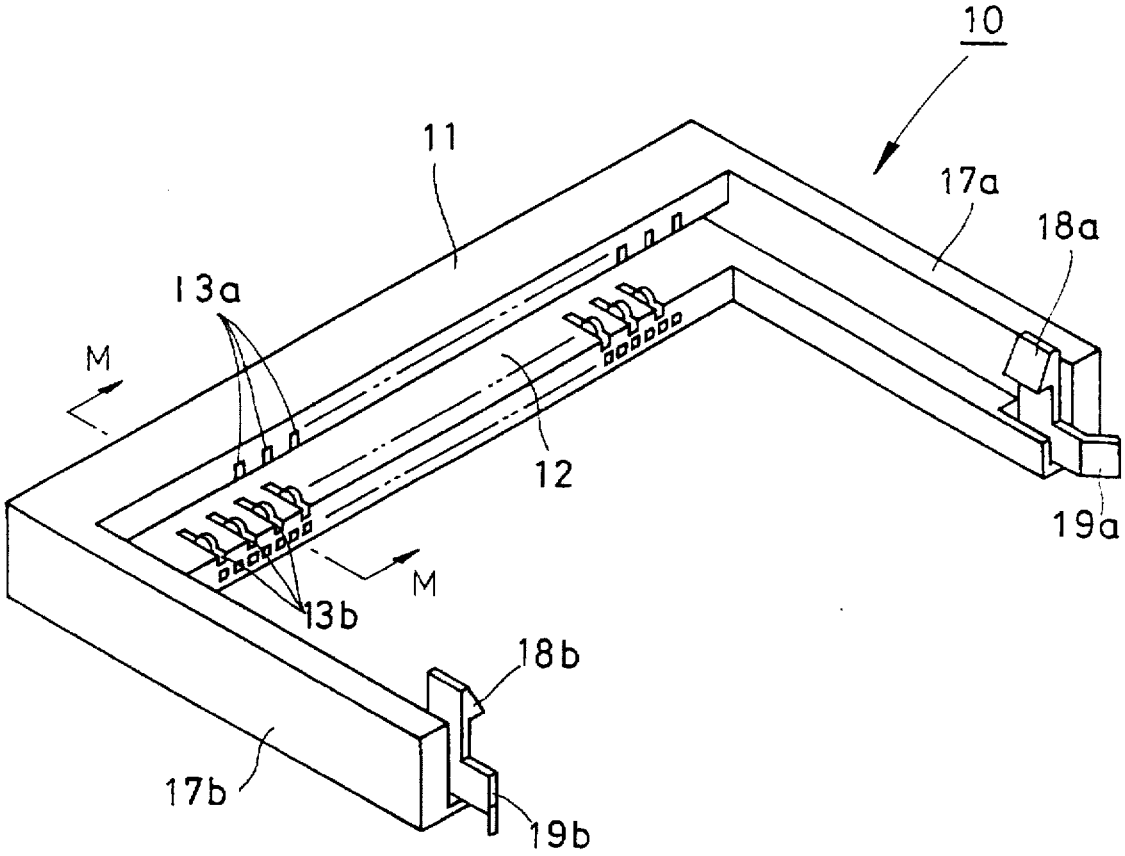
Fig. 43 PRIOR ART
FIG. 43 is a schematic perspective view of a conventional electrical connector for DIMMs.
Figure 44:
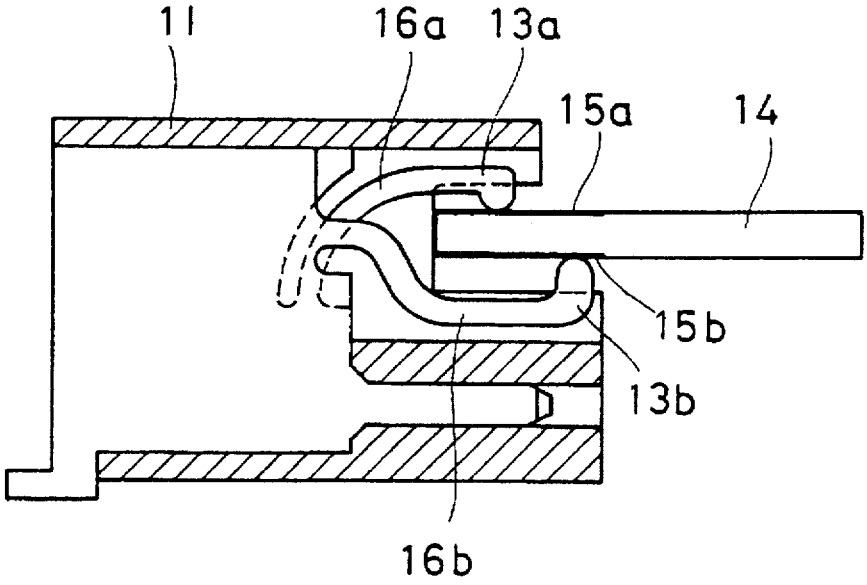
Fig. 44 PRIOR ART
FIG. 44 is a schematic cross section corresponding to cross section M—M in FIG. 43.
Figure 45:
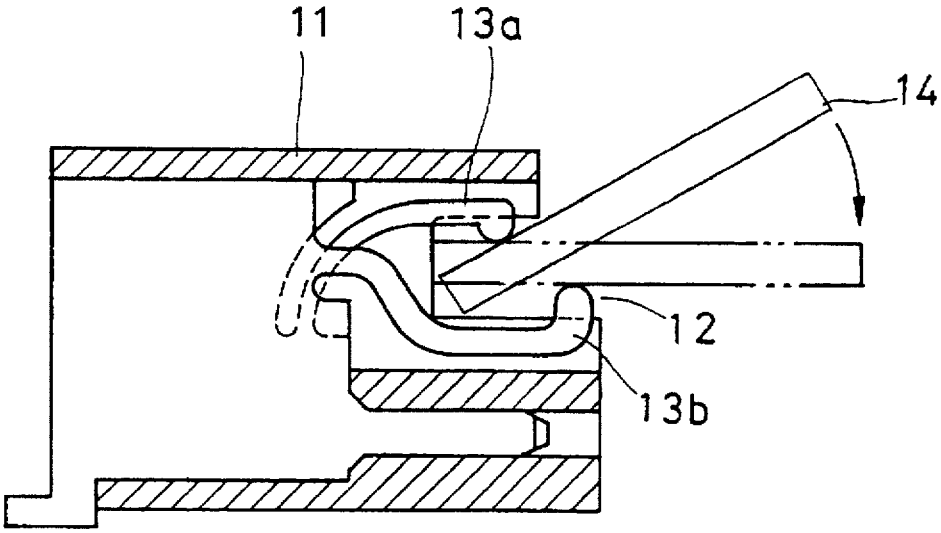
Fig. 45 PRIOR ART
FIG. 45 is a schematic cross section depicting the connector when a module is being mounted.

The arm components 214*a* and 214*b* of the upper stage housing 212*a* shown in FIG. 32 are then returned to their original position, pivoting on the support shaft 218, resulting in a state allowing a module to be inserted into the upper stage housing 212*a*. Then, as shown in FIG. 39, a second module 245 is inserted into the groove 213*a* of the upper stage housing 212*a*, and the module 245 is rotated in the direction indicated by the arrow and is housed inside the housing 212*a*. At this time, the latch components 216*a* and 216*b* shown in FIG. 32 engage the module 245 on either side, and the module 245 is mounted in the housing 212*a*. At the same time, the first movable terminals 221*a* and the second movable terminals 222*a* in the housing 212*a* are electrically connected by resilient contact with the electrode terminals (not shown in figure) of the module 245. At this time, the module 245 is fixed in a pressed state from above and below by the first movable terminals 221*a* and second movable terminals 222*a*.

When the first movable terminals in the upper and lower stages identically located planewise and the second movable terminals in the upper and lower stages similarly identically located planewise are thus integrally formed, it is possible to obtain an electrical connection between these movable terminals and the electrode terminals formed on either side of the modules, in the same way as when upper and lower stage movable terminals are formed separately. Accordingly, in cases involving the use of terminals in which upper and lower stage movable terminals are identically located planewise, as in the connector of this preferred embodiment, the number of electrode parts can be reduced to nearly half the number in cases where the upper and lower stage movable terminals are formed separately. Because it is also possible to attach the first and second movable terminals in the upper and lower stages in a single operation, the installation of the electrode components is simplified.

In the Embodiment 8 above, the configuration of the first and second movable terminals is not limited to that depicted in the figures. That is, the upper and lower stage terminals identically located planewise may be formed in other configurations, provided that they are integrally formed.

The connector of Embodiment 8 was described with reference to an example in which the first and second movable terminals integrally formed in the upper and lower stages and the third and fourth movable terminals separately formed in the upper and lower stages were arranged in the same housing, but the connector may also be constructed solely with first and second movable terminals integrally formed in upper and lower stages.

As described above, the electrical connector pertaining to the second of the inventions is constructed in such a way that the upper and lower stage first movable terminals identically located planewise and the upper and lower stage second movable terminals similarly identically located planewise are integrally formed. Thus, even when the housing is arranged in two stages above and below, the number of electrode parts can be kept to nearly the same number as for a single stage. Because, moreover, the first and second movable terminals in the upper and lower stages can be attached at once, the electrode parts can be installed in a simple manner.

The present invention can be implemented in a variety of other embodiments without deviating from the spirit or essential features. As such, the preferred embodiments described above are, in all respects, only simple examples and should not be construed in any limiting sense. The scope of the present invention is indicated by the claims and is not in any way constrained by the specification. All modifications or changes within the uniform scope of the claims fall within the scope of the invention.

What is claimed is:

1. An electrical connector for electrically connecting a motherboard and extension boards, comprising:

at least two housings, into which extension boards are inserted, arranged in stages one over another in such a manner that a housing on an upper stage side is constructed in such a manner that it can be evacuated as far as a location where it will not interfere with a course along with an extension board is inserted into a housing on the lower stage side, wherein the housing on the upper stage side has a pair of arms for holding an extension board which are rotatably supported by a pivoting shaft arranged parallel to a longitudinal direction of the housing on the lower stage side.

2. An electrical connector for electrically connecting a motherboard and extension boards, comprising:

at least two housings, into which extension boards are inserted, arranged in stages one over another in such a manner that a housing on an upper stage side is constructed in such a manner that it can be evacuated as far as a location where it will not interfere with a course along with an extension board is inserted into a housing on the lower stage side, wherein the housing on the upper stage side has a pair of arms for holding an extension board which are rotatably supported by pivoting shafts arranged orthogonal to the longitudinal direction of the housing on the lower stage side.

3. An electrical connector according to claim 2, wherein the pair of arms are provided with a frame for housing two extension boards in the housing on the upper stage side.

4. An electrical connector for electrically connecting a motherboard and extension boards, comprising:

at least two housings, into which extension boards are inserted, arranged in stages one over another in such a manner that a housing on an upper stage side is constructed in such a manner that it can be evacuated as far as a location where it will not interfere with a course along with an extension board is inserted into a housing on the lower stage side, wherein the housing on the upper stage side has a pair of arms which are rotatably supported by pivoting shafts arranged perpendicular to the housing on the lower stage side.

5. An electrical connector for electrically connecting a motherboard and extension boards, comprising:

at least two housings, into which extension boards are inserted, arranged in stages one over another in such a manner that a housing on an upper stage side is constructed in such a manner that it can be evacuated as far as a location where it will not interfere with a course along with an extension board is inserted into a housing on the lower stage side, wherein the housing on the upper stage side has a pair of arms which are movably supported parallel to the longitudinal direction of the housing on the lower stage side.

6. An electrical connector for detachably holding extension boards relative to a motherboard and for electrically connecting the extension boards and the motherboard, comprising:

two housings, into which extension boards provided with electrode terminals on both sides thereof are inserted, arranged in two stages one over another; and a plurality of alternately arranged first and second movable terminals provided in each of the housings, the first and second movable terminals being adapted to contact with the electrode terminals on both sides of the extension boards;

wherein corresponding ones of the first movable terminals which are identically located planewise in the upper and lower housings are formed integrally, and corresponding ones of the second movable terminals which are identically located planewise in the upper and lower housings are formed integrally.

7. An electrical connector according to claim 6, wherein some of the corresponding ones of the first movable terminals and the second movable terminals are separately formed in each of the housings.

* * * * *